US009447648B2

(12) United States Patent
Mitchell

(10) Patent No.: US 9,447,648 B2
(45) Date of Patent: Sep. 20, 2016

(54) HIGH EXPANSION OR DUAL LINK GRIPPER

(71) Applicant: WWT NORTH AMERICA HOLDINGS, INC., Houston, TX (US)

(72) Inventor: Sarah Brianne Mitchell, Corona, CA (US)

(73) Assignee: WWT NORTH AMERICA HOLDINGS, INC, Houston, TX (US)

( * ) Notice: Subject to any disclaimer, the term of this patent is extended or adjusted under 35 U.S.C. 154(b) by 621 days.

(21) Appl. No.: 13/659,780

(22) Filed: Oct. 24, 2012

(65) Prior Publication Data

US 2013/0113227 A1 May 9, 2013

Related U.S. Application Data

(60) Provisional application No. 61/613,330, filed on Mar. 20, 2012, provisional application No. 61/588,544, filed on Jan. 19, 2012, provisional application No. 61/553,096, filed on Oct. 28, 2011.

(51) Int. Cl.

| | |
|---|---|
| ***E21B 23/00*** | (2006.01) |
| ***E21B 23/14*** | (2006.01) |
| ***E21B 4/18*** | (2006.01) |

(52) U.S. Cl.

CPC ..... *E21B 23/00* (2013.01); *E21B 4/18* (2013.01); *E21B 23/14* (2013.01)

(58) Field of Classification Search

USPC ..... 166/382, 212, 217; 175/98, 99

See application file for complete search history.

(56) References Cited

U.S. PATENT DOCUMENTS

| | | | |
|---|---|---|---|
| 2,141,030 | A | 12/1938 | Clark |
| 2,167,194 | A | 7/1939 | Anderson |
| 2,271,005 | A | 1/1942 | Grebe |
| 2,569,457 | A | 10/1951 | Dale et al. |
| 2,727,722 | A | 12/1955 | Conboy |
| 2,783,028 | A | 2/1957 | Jamison |
| 2,946,565 | A | 7/1960 | Williams |

(Continued)

FOREIGN PATENT DOCUMENTS

| | | |
|---|---|---|
| AU | 2002-230623 | 7/2007 |
| AU | 2004-4210989 | 3/2009 |

(Continued)

OTHER PUBLICATIONS

UK Search Report dated May 25, 2007 for Application GB0704656.8.

(Continued)

*Primary Examiner* — Taras P Bemko

(74) *Attorney, Agent, or Firm* — Knobbe, Martens, Olson & Bear, LLP

(57) ABSTRACT

A gripper mechanism for a downhole tool is disclosed that includes a linkage mechanism. In operation, an axial force generated by a power section of the gripper expands the linkage mechanism, which applies a radial force to the interior surface of a wellbore or passage. For certain expansion diameters, the expansion force can be primarily transmitted from a roller-ramp interface expanding the linkage. For other expansion diameters, the expansion force can be primarily provided by expansion of the linkage, in which during a first stage the expansion force is primarily provided by a first link and during a second stage the expansion force is primarily provided by a second link. Thus, the gripper can provide a desired expansion force over a large range of expansion diameters.

24 Claims, 19 Drawing Sheets

(56) References Cited

U.S. PATENT DOCUMENTS

| | | | |
|---|---|---|---|
| 2,946,578 | A | 7/1960 | De Smaele |
| 3,138,214 | A | 6/1964 | Bridwell |
| 3,180,436 | A | 4/1965 | Kellner et al. |
| 3,180,437 | A | 4/1965 | Kellner et al. |
| 3,185,225 | A | 5/1965 | Ginies |
| 3,224,513 | A | 12/1965 | Weeden, Jr. |
| 3,224,734 | A | 12/1965 | Hill |
| 3,225,843 | A | 12/1965 | Ortloff et al. |
| 3,376,942 | A | 4/1968 | Van Winkle |
| 3,497,019 | A | 2/1970 | Ortloff |
| 3,599,712 | A | 8/1971 | Magill |
| 3,606,924 | A | 9/1971 | Malone |
| 3,661,205 | A | 5/1972 | Belorgey |
| 3,664,416 | A | 5/1972 | Nicolas et al. |
| 3,797,589 | A | 3/1974 | Kellner et al. |
| 3,827,512 | A | 8/1974 | Edmond |
| RE28,449 | E | 6/1975 | Edmond |
| 3,941,190 | A | 3/1976 | Conover |
| 3,978,930 | A | 9/1976 | Schroeder |
| 3,992,565 | A | 11/1976 | Gatfield |
| 4,040,494 | A | 8/1977 | Kellner |
| 4,085,808 | A | 4/1978 | Kling |
| 4,095,655 | A | 6/1978 | Still |
| 4,141,414 | A | 2/1979 | Johansson |
| 4,184,546 | A | 1/1980 | Nicolas et al. |
| 4,274,758 | A | 6/1981 | Schosek |
| 4,314,615 | A | 2/1982 | Sodder, Jr. et al. |
| 4,365,676 | A | 12/1982 | Boyadjieff et al. |
| 4,372,161 | A | 2/1983 | de Buda et al. |
| 4,385,021 | A | 5/1983 | Neeley |
| 4,440,239 | A | 4/1984 | Evans |
| 4,463,814 | A | 8/1984 | Horstmeyer et al. |
| 4,558,751 | A | 12/1985 | Huffaker |
| 4,573,537 | A | 3/1986 | Hirasuna et al. |
| 4,588,951 | A | 5/1986 | Ohmer |
| 4,600,974 | A | 7/1986 | Lew et al. |
| 4,615,401 | A | 10/1986 | Garrett |
| 4,674,914 | A | 6/1987 | Wayman et al. |
| 4,686,653 | A | 8/1987 | Staron et al. |
| 4,811,785 | A | 3/1989 | Weber |
| 4,821,817 | A | 4/1989 | Cendre et al. |
| 4,854,397 | A | 8/1989 | Warren et al. |
| 4,926,937 | A | 5/1990 | Hademenos |
| 4,951,760 | A | 8/1990 | Cendre et al. |
| 5,010,965 | A | 4/1991 | Schmelzer |
| 5,052,211 | A | 10/1991 | Cohrs et al. |
| 5,090,259 | A | 2/1992 | Shishido et al. |
| 5,169,264 | A | 12/1992 | Kimura |
| 5,184,676 | A | 2/1993 | Graham et al. |
| 5,186,264 | A | 2/1993 | du Chaffaut |
| 5,203,646 | A | 4/1993 | Landsberger et al. |
| 5,310,012 | A | 5/1994 | Cendre et al. |
| 5,316,094 | A | 5/1994 | Pringle et al. |
| 5,358,039 | A | 10/1994 | Fordham |
| 5,358,040 | A | 10/1994 | Kinley et al. |
| 5,363,929 | A | 11/1994 | Williams et al. |
| 5,394,951 | A | 3/1995 | Pringle et al. |
| 5,419,405 | A | 5/1995 | Patton |
| 5,425,429 | A | 6/1995 | Thompson |
| 5,449,047 | A | 9/1995 | Schivley, Jr. |
| 5,467,832 | A | 11/1995 | Orban et al. |
| 5,494,111 | A | 2/1996 | Davis |
| 5,519,668 | A | 5/1996 | Montaron |
| 5,542,253 | A | 8/1996 | Ganzel |
| 5,613,568 | A | 3/1997 | Sterner et al. |
| 5,622,231 | A | 4/1997 | Thompson |
| 5,752,572 | A | 5/1998 | Baiden et al. |
| 5,758,731 | A | 6/1998 | Zollinger |
| 5,758,732 | A | 6/1998 | Liw |
| 5,765,640 | A | 6/1998 | Milne et al. |
| 5,794,703 | A | 8/1998 | Newman et al. |
| 5,803,193 | A | 9/1998 | Krueger et al. |
| 5,845,796 | A | 12/1998 | Miller |
| 5,857,731 | A | 1/1999 | Heim et al. |
| 5,947,213 | A | 9/1999 | Angle et al. |
| 5,954,131 | A | 9/1999 | Sallwasser |
| 5,960,895 | A | 10/1999 | Chevallier et al. |
| 5,979,550 | A | 11/1999 | Tessier |
| 5,996,979 | A | 12/1999 | Hrusch |
| 6,003,606 | A | 12/1999 | Moore et al. |
| 6,026,911 | A | 2/2000 | Angle et al. |
| 6,031,371 | A | 2/2000 | Smart |
| 6,082,461 | A | 7/2000 | Newman |
| 6,089,323 | A | 7/2000 | Newman et al. |
| 6,112,809 | A | 9/2000 | Angle |
| 6,216,779 | B1 | 4/2001 | Reinhardt |
| 6,230,813 | B1 | 5/2001 | Moore et al. |
| 6,232,773 | B1 | 5/2001 | Jacobs et al. |
| 6,241,031 | B1 | 6/2001 | Beaufort et al. |
| 6,273,189 | B1 | 8/2001 | Gissler et al. |
| 6,286,592 | B1 | 9/2001 | Moore et al. |
| 6,315,043 | B1 | 11/2001 | Farrant et al. |
| 6,345,669 | B1 | 2/2002 | Buyers et al. |
| 6,347,674 | B1 | 2/2002 | Bloom et al. |
| 6,378,627 | B1 | 4/2002 | Tubel et al. |
| 6,427,786 | B2 | 8/2002 | Beaufort et al. |
| 6,431,270 | B1 | 8/2002 | Angle |
| 6,431,291 | B1 | 8/2002 | Moore et al. |
| 6,464,003 | B2 | 10/2002 | Bloom et al. |
| 6,478,097 | B2 | 11/2002 | Bloom et al. |
| 6,601,652 | B1 | 8/2003 | Moore et al. |
| 6,609,579 | B2 | 8/2003 | Krueger et al. |
| 6,629,568 | B2 | 10/2003 | Post et al. |
| 6,640,894 | B2 | 11/2003 | Bloom et al. |
| 6,651,747 | B2 | 11/2003 | Chen et al. |
| 6,679,341 | B2 | 1/2004 | Bloom et al. |
| 6,702,010 | B2 | 3/2004 | Yuratich et al. |
| 6,712,134 | B2 | 3/2004 | Stoesz |
| 6,715,559 | B2 | 4/2004 | Bloom et al. |
| 6,722,442 | B2 | 4/2004 | Simpson |
| 6,745,854 | B2 | 6/2004 | Bloom et al. |
| 6,758,279 | B2 | 7/2004 | Moore et al. |
| 6,796,380 | B2 | 9/2004 | Xu |
| 6,827,149 | B2 | 12/2004 | Hache |
| 6,868,906 | B1 | 3/2005 | Vail, III et al. |
| 6,910,533 | B2 | 6/2005 | Guerrero |
| 6,920,936 | B2 | 7/2005 | Sheiretov et al. |
| 6,935,423 | B2 | 8/2005 | Kusmer |
| 6,938,708 | B2 | 9/2005 | Bloom et al. |
| 6,953,086 | B2 | 10/2005 | Simpson |
| 7,048,047 | B2 | 5/2006 | Bloom et al. |
| 7,059,417 | B2 | 6/2006 | Moore et al. |
| 7,080,700 | B2 | 7/2006 | Bloom et al. |
| 7,080,701 | B2 | 7/2006 | Bloom et al. |
| 7,090,007 | B2 | 8/2006 | Stuart-Bruges et al. |
| 7,121,364 | B2 | 10/2006 | Mock et al. |
| 7,143,843 | B2 | 12/2006 | Doering et al. |
| 7,156,181 | B2 | 1/2007 | Moore et al. |
| 7,156,192 | B2 | 1/2007 | Guerrero et al. |
| 7,172,026 | B2 | 2/2007 | Misselbrook |
| 7,174,974 | B2 | 2/2007 | Bloom et al. |
| 7,185,716 | B2 | 3/2007 | Bloom et al. |
| 7,188,681 | B2 | 3/2007 | Bloom et al. |
| 7,191,829 | B2 | 3/2007 | Bloom et al. |
| 7,215,253 | B2 | 5/2007 | Baek et al. |
| 7,222,682 | B2 | 5/2007 | Doering et al. |
| 7,252,143 | B2 | 8/2007 | Sellers et al. |
| 7,273,109 | B2 | 9/2007 | Moore et al. |
| 7,275,593 | B2 | 10/2007 | Bloom et al. |
| 7,303,010 | B2 | 12/2007 | de Guzman et al. |
| 7,334,642 | B2 | 2/2008 | Doering et al. |
| 7,337,850 | B2 | 3/2008 | Contant |
| 7,343,982 | B2 | 3/2008 | Mock et al. |
| 7,353,886 | B2 | 4/2008 | Bloom et al. |
| 7,392,859 | B2 | 7/2008 | Mock et al. |
| 7,401,665 | B2 | 7/2008 | Guerrero et al. |
| 7,493,967 | B2 | 2/2009 | Mock et al. |
| 7,516,782 | B2 | 4/2009 | Sheiretov et al. |
| 7,516,792 | B2 | 4/2009 | Lonnes et al. |
| 7,604,060 | B2 | 10/2009 | Bloom et al. |
| 7,607,495 | B2 | 10/2009 | Bloom et al. |
| 7,607,497 | B2 | 10/2009 | Mock et al. |
| 7,624,808 | B2 | 12/2009 | Mock |
| 7,743,849 | B2 | 6/2010 | Kotsonis et al. |

(56) References Cited

U.S. PATENT DOCUMENTS

| | | | | |
|---|---|---|---|---|
| 7,748,476 | B2 | 7/2010 | Krueger, V | |
| 7,770,667 | B2 | 8/2010 | Moore | |
| 7,775,272 | B2 | 8/2010 | Nelson et al. | |
| 7,784,564 | B2 | 8/2010 | Iskander et al. | |
| 7,832,488 | B2 | 11/2010 | Guerrero et al. | |
| 7,836,950 | B2 | 11/2010 | Vail, III et al. | |
| 7,854,258 | B2 | 12/2010 | Sheiretov et al. | |
| 7,857,067 | B2 | 12/2010 | Tunc et al. | |
| 7,886,834 | B2 | 2/2011 | Spencer et al. | |
| 7,896,088 | B2 | 3/2011 | Guerrero et al. | |
| 7,900,699 | B2 | 3/2011 | Ramos et al. | |
| 7,954,562 | B2 | 6/2011 | Mock | |
| 7,954,563 | B2 | 6/2011 | Mock et al. | |
| 8,028,766 | B2 | 10/2011 | Moore | |
| 8,061,447 | B2 | 11/2011 | Krueger | |
| 8,069,917 | B2 | 12/2011 | Bloom et al. | |
| 8,082,988 | B2 | 12/2011 | Redlinger et al. | |
| 8,151,902 | B2 | 4/2012 | Lynde et al. | |
| 8,245,796 | B2 | 8/2012 | Mock et al. | |
| 8,286,716 | B2 | 10/2012 | Martinez et al. | |
| 8,485,253 | B2 | 7/2013 | Jacob | |
| 8,485,278 | B2 | 7/2013 | Mock | |
| 8,555,963 | B2 | 10/2013 | Bloom et al. | |
| 8,579,037 | B2 | 11/2013 | Jacob | |
| 8,602,115 | B2 | 12/2013 | Aguirre et al. | |
| 8,944,161 | B2 | 2/2015 | Bloom et al. | |
| 2001/0045300 | A1 | 11/2001 | Fincher et al. | |
| 2002/0007971 | A1 | 1/2002 | Beaufort et al. | |
| 2002/0029908 | A1 | 3/2002 | Bloom et al. | |
| 2005/0145415 | A1 | 7/2005 | Doering et al. | |
| 2007/0095532 | A1 | 5/2007 | Head et al. | |
| 2007/0181298 | A1* | 8/2007 | Sheiretov | E21B 4/18 166/212 |
| 2007/0261887 | A1 | 11/2007 | Pai et al. | |
| 2008/0061647 | A1 | 3/2008 | Schmitt | |
| 2008/0066963 | A1 | 3/2008 | Sheiretov et al. | |
| 2008/0073077 | A1 | 3/2008 | Tunc et al. | |
| 2008/0110635 | A1 | 5/2008 | Loretz et al. | |
| 2008/0149339 | A1* | 6/2008 | Krueger, V | 166/301 |
| 2008/0196901 | A1 | 8/2008 | Aguirre et al. | |
| 2008/0202769 | A1 | 8/2008 | Dupree et al. | |
| 2008/0314639 | A1 | 12/2008 | Kotsonis et al. | |
| 2009/0008150 | A1 | 1/2009 | Lavrut et al. | |
| 2009/0071660 | A1 | 3/2009 | Martinez et al. | |
| 2009/0091278 | A1 | 4/2009 | Montois et al. | |
| 2009/0159295 | A1 | 6/2009 | Guerrero et al. | |
| 2009/0218105 | A1 | 9/2009 | Hill et al. | |
| 2009/0229820 | A1 | 9/2009 | Saeed | |
| 2009/0236101 | A1 | 9/2009 | Nelson et al. | |
| 2009/0294124 | A1 | 12/2009 | Patel | |
| 2009/0321141 | A1 | 12/2009 | Kotsonis et al. | |
| 2010/0018695 | A1* | 1/2010 | Bloom et al. | 166/206 |
| 2010/0038138 | A1 | 2/2010 | Mock et al. | |
| 2010/0108387 | A1 | 5/2010 | Bloom et al. | |
| 2010/0108394 | A1 | 5/2010 | Ollerenshaw et al. | |
| 2011/0127046 | A1 | 6/2011 | Aguirre et al. | |
| 2012/0061075 | A1 | 3/2012 | Mock | |
| 2015/0211312 | A1 | 7/2015 | Krueger | |

FOREIGN PATENT DOCUMENTS

| | | | |
|---|---|---|---|
| CA | 2 250 483 | | 4/1999 |
| CA | 2 336 421 | | 1/2006 |
| CA | 2 436 944 | | 5/2012 |
| CA | 2 515 482 | | 5/2013 |
| DE | 2439063 | A1 | 2/1976 |
| DE | 29 20 049 | | 2/1981 |
| EP | 0 149 528 | A1 | 7/1985 |
| EP | 0 951 611 | B1 | 1/1993 |
| EP | 0 257 744 | B1 | 1/1995 |
| EP | 0 767 289 | A1 | 4/1997 |
| EP | 0911483 | | 4/1997 |
| EP | 1 281 834 | A | 2/2003 |
| EP | 1 344 893 | A2 | 9/2003 |
| EP | 1370891 | | 11/2006 |
| EP | 1 845 230 | | 10/2007 |
| EP | 1223305 | | 4/2008 |
| GB | 894117 | | 4/1962 |
| GB | 1105701 | | 3/1968 |
| GB | 2048339 | | 12/1980 |
| GB | 2 241 723 | A | 9/1991 |
| GB | 2 305 407 | | 4/1997 |
| GB | 2 310 871 | A | 9/1997 |
| GB | 2 346 908 | A | 8/2000 |
| GB | 2 362 405 | | 11/2004 |
| GB | 2401130 | | 11/2004 |
| GB | 2 389 135 | | 11/2005 |
| GB | 2 413 813 | | 1/2006 |
| GB | 2 414 499 | | 6/2006 |
| NO | 317476 | | 11/2004 |
| NO | 328145 | | 12/2009 |
| WO | WO 89/05391 | | 6/1989 |
| WO | WO 92/13226 | | 8/1992 |
| WO | WO 93/18277 | | 9/1993 |
| WO | WO 94/27022 | | 11/1994 |
| WO | WO 95/21987 | | 8/1995 |
| WO | WO 98/01651 | | 1/1998 |
| WO | WO 00/36266 | | 6/2000 |
| WO | WO 00/46461 | | 8/2000 |
| WO | WO 00/63606 | | 10/2000 |
| WO | WO 00/73619 | | 12/2000 |
| WO | WO 02/44509 | A2 | 6/2002 |
| WO | WO 2004/072433 | | 8/2004 |
| WO | WO 2005/057076 | | 6/2005 |
| WO | WO 2007039025 | | 4/2007 |
| WO | WO 2007134748 | | 11/2007 |
| WO | WO 2008/061100 | | 5/2008 |
| WO | WO 2008/104177 | | 9/2008 |
| WO | WO 2008/104178 | | 9/2008 |
| WO | WO 2008/104179 | | 9/2008 |
| WO | WO 2008/128542 | | 10/2008 |
| WO | WO 2008/128543 | | 10/2008 |
| WO | WO 2009/062718 | | 5/2009 |
| WO | WO 2010/062186 | | 6/2010 |
| WO | WO 2011/005519 | | 1/2011 |
| WO | WO 2013/063317 | | 6/2014 |
| WO | WO 2015/112353 | | 7/2015 |

OTHER PUBLICATIONS

PCT International Search Report and Written Opinion of the ISA dated Jun. 16, 2005 for International Application No. PCT/US2005/008919.

PCT International Search Report and Written Opinion of the ISA dated Apr. 22, 2008 for International Application No. PCT/US2007/084574.

"Kilobomac to Challenge Tradition" Norwegian Oil Review, 1988, pp. 50-52.

U.S. Appl. No. 60/201,353, and cover sheet, filed May 2, 2000 entitled "Borehole Retention Device" in 22 pages.

U.S. Appl. No. 12/368,417, entitled "Tractor With Improved Valve System", filed on Feb. 10, 2009.

U.S. Appl. No. 12/606,986, entitled "Tractor With Improved Valve System", filed on Oct. 27, 2009.

U.S. Appl. No. 12/605,228, entitled "Roller Link Toggle Gripper and Downhole Tractor", filed on Oct. 23, 2009.

PCT International Search Report and Written Opinion for PCT Application No. PCT/US2012/061988, mailed Dec. 17, 2013.

PCT International Preliminary Report on Patentability for PCT Application No. PCT/US2012/061988, mailed Apr. 29, 2014.

PCT International Search Report and Written Opinion for PCT Application No. PCT/US2015/010889, mailed May 27, 2015.

* cited by examiner

HIGH EXPANSION OR DUAL LINK GRIPPER

CROSS-REFERENCE TO RELATED APPLICATIONS

This application claims the benefit of U.S. Provisional Patent Application No. 61/613,330, entitled "HIGH EXPANSION OR DUAL LINK GRIPPER," filed on Mar. 20, 2012, U.S. Provisional Patent Application No. 61/588,544, filed on Jan. 19, 2012, entitled "HIGH EXPANSION GRIPPER," U.S. Provisional Patent Application No. 61/553,096, filed on Oct. 28, 2011, entitled "HIGH EXPANSION GRIPPER" which are hereby incorporated by reference in their entirety.

FIELD OF THE INVENTION

The present application relates generally to gripping mechanisms for downhole tools.

DESCRIPTION OF THE RELATED ART

Tractors for moving within downhole passages are often required to operate in harsh environments and limited space. For example, tractors used for oil drilling may encounter hydrostatic pressures as high as 16,000 psi and temperatures as high as 300° F.

WWT International, Incorporated has developed a variety of downhole tractors for drilling, completion and intervention processes for wells and boreholes. These various tractors are intended to provide locomotion, to pull or push various types of loads. For each of these various types of tractors, various types of gripper elements have been developed. Thus an important part of the downhole tractor tool is its gripper system.

In one known design, a tractor comprises an elongated body, a propulsion system for applying thrust to the body, and grippers for anchoring the tractor to the inner surface of a borehole or passage while such thrust is applied to the body. Each gripper has an actuated position in which the gripper substantially prevents relative movement between the gripper and the inner surface of the passage using outward radial force, and a second, typically retracted, position in which the gripper permits substantially free relative movement between the gripper and the inner surface of the passage. Typically, each gripper is slidingly engaged with the tractor body so that the body can be thrust longitudinally while the gripper is actuated.

SUMMARY OF THE INVENTION

One aspect of at least one embodiment of the invention is the recognition that it would be desirable to have a gripper having a wide range of expansion while maintaining the ability to collapse within a small diameter in order to provide gripping ability in wide and narrow boreholes or passages. Typical boreholes for oil drilling are 3.5-27.5 inches in diameter. Accordingly, tractors are desirably capable of a wide range of expansion while also retaining the ability to collapse within a small envelope. Also, tractors desirably also have the capability to generate and exert substantial force against a formation at high ranges of expansion.

Another aspect of at least one embodiment of the present invention is the recognition that it would be desirable to have a gripper device with the ability to center itself within the borehole or passage.

Yet another inventive aspect of at least one embodiment of the present invention is the recognition that it would be desirable to have the gripper provide a substantial amount of initial force to start the expansion process.

A further inventive aspect of at least one embodiment of the present invention is the recognition that it would be desirable to have a gripper provide at least 3000 lbs of radial load against the borehole or passage at higher expansion ranges, such as within the useable range from approximately 7.5 inches in diameter to approximately 12 inches in diameter. Desirably, the tractor would also be able to collapse within an envelope of 3.5 inches in diameter to fit within well bores smaller than 10 inches, 7 inches or 4 inches in diameter.

In one embodiment, a gripper assembly comprises a link mechanism comprising a tension link connected to a first and a second lift link; the first and second lift links slidably attached to an elongate body; a roller disposed on an end of said first lift link; a slot disposed in said tension link, the slot comprising a first end and a second end opposite said first end; and an expansion surface upon which said roller acts to provide an expansion force. For a first expansion range the movement of the roller upon the expansion surface expands the linkage; for a second expansion range the movement of the first lift link pushing against the second end of the slot expands the linkage; and for a third expansion range the movement of the second lift link expands the linkage.

In one embodiment, a gripper assembly comprises an elongate body and at least one linkage comprising a first lift link, a second lift link and a tension link, wherein the second lift link and the tension link are pivotably interconnected in series and expandable relative to the elongate body from a retracted position to an expanded position. The first lift link has a first end slidably coupled to the elongate body and a second end disposed in a slot within the tension link, said slot having a first end and a second end; the second lift link has a first end slidably coupled to the elongate body and a second end that is radially extendable from the elongate body. The tension link has a first end pivotally coupled to the elongate body and a second end that is radially extendable from the elongate body. For a first expansion range the movement of the second end of the first lift link pushing against the second end of the slot expands the linkage, and for a second expansion range the movement of the second lift link radially away from the elongate body expands the linkage.

In one embodiment, a method for imparting a force to a passage comprises the steps of positioning a force applicator in the passage, the force applicator comprising an expandable assembly comprising an elongate body and at least one linkage comprising a tension link having a first end coupled to the elongate body and a second end opposite the first end, a slot disposed in the tension link, said slot having a first end and a second end, a first lift link having a first end slidably coupled to the elongate body and a second end slidably disposed within the slot, a second lift link having a first end slidably coupled to the elongate body and a second end opposite the first end coupled to the second end of the tension link; generating a radial expansion force over a first expansion range by moving the second end of the first lift link against the second end of the slot to expand the linkage; and generating a radial expansion force over a second expansion range by moving the second end of the second lift link radially away from the elongate body to expand the linkage.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Overview—High Expansion Gripper

Figure 1:
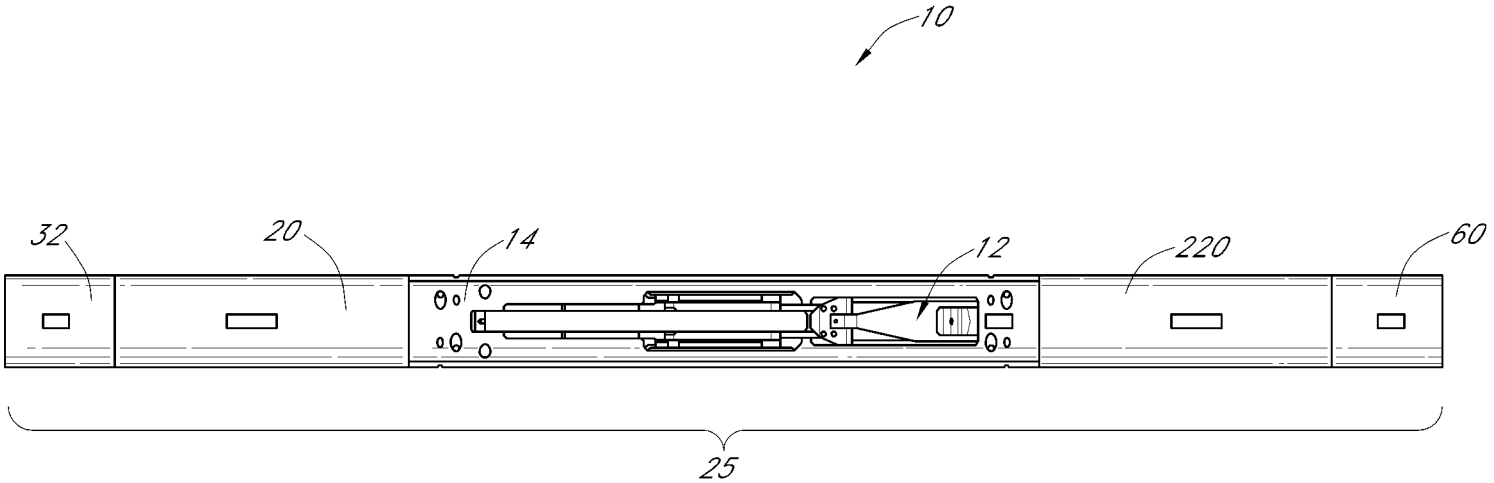
FIG. 1 is a side view of one embodiment of a gripper assembly according to the present invention.

With respect to FIG. 1, in certain embodiments, an expandable gripping section 14 can comprise a linkage or link mechanism 12. In some embodiments, the linkage 12 comprises three links designed to operate in a wide range of expansion diameters. As further described below, the linkage 12 can accomplish large maximum to collapsed diameter ratios for the gripper assembly. One benefit of this new High Expansion (HE) Gripper is that preferred expansion forces are desirably maintained over a wider diametrical range than current grippers in commercial use. Accordingly, the HE gripper can desirably be used in wellbores having relatively small entry locations, but relatively larger internal diameters.

Figure 2A:
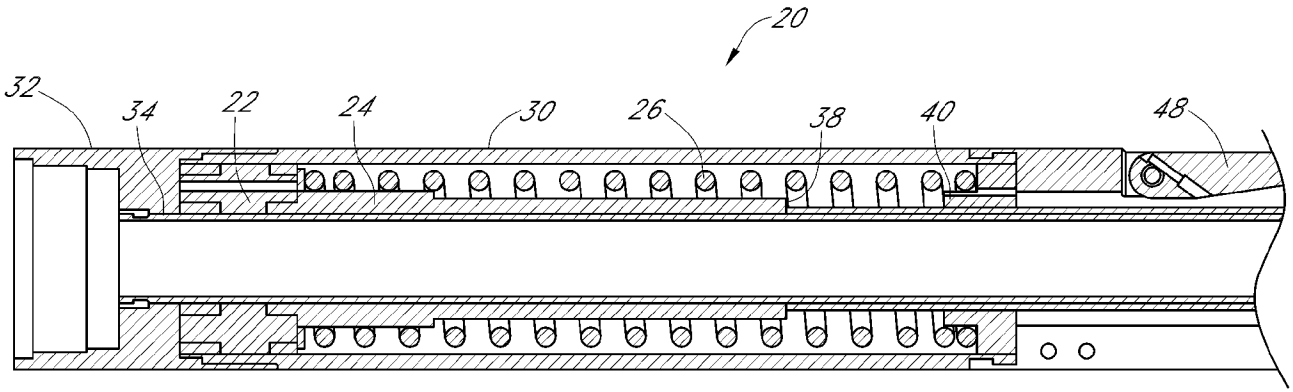
FIG. 2A is a cross-sectional side view of an actuator of the gripper assembly of FIG. 1.
Figure 2B:
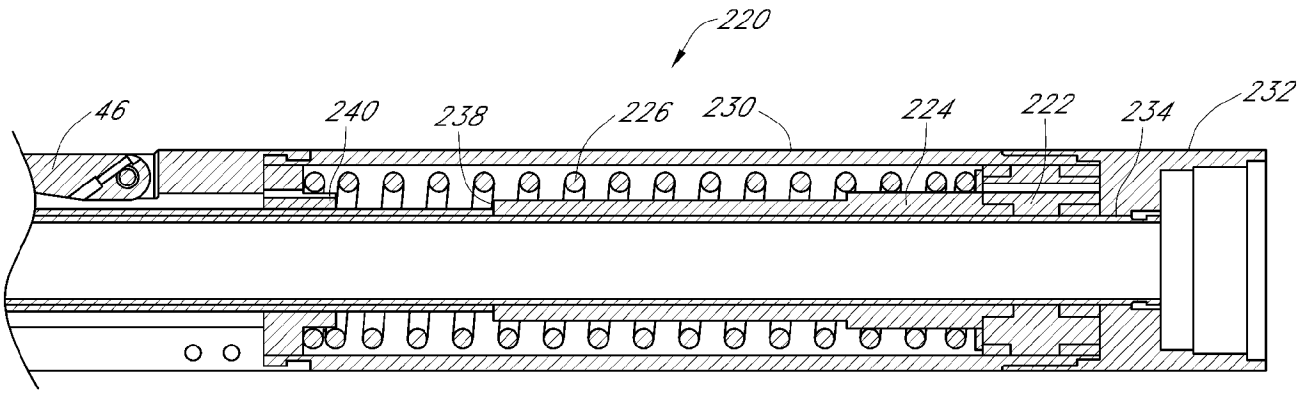
FIG. 2B is a cross-sectional side view of an actuator of the gripper assembly of FIG. 1.

With reference to FIGS. 1 and 2A-B, and as further described below, in certain embodiments, the gripper assembly can include power sections or actuators 20 and 220 to actuate the gripper between a collapsed state and an expanded state. In some embodiments, the power sections 20 and 220 can comprise hydraulically-actuated pistons 22 and 222-in-a-cylinder 30 and 230. A piston force generated within the cylinders 30 and 230 of the HE gripper assembly 10 may advantageously start the gripper expansion process. As discussed in greater detail below, this force can desirably be conveyed through piston rods 24 and 224 to thrust a first end 62 of a short lift link 44 and a first end 72 of a longer lift link 46 axially towards each other. In some embodiments, rollers attached to the short lift link 44 extend up an expansion surface such as defined by a ramp 90. This expansion surface can exert an expansion force on the link connection, which in turn exerts an expansion force on an inner surface of a formation or casing that the linkage is in contact with. As discussed in greater detail below, at greater expansion diameters, the links of the linkage 12 can depart the expansion surface.

Additionally, the entire specification of U.S. Pat. No. 7,748,476, entitled "VARIABLE LINKAGE GRIPPER," including the drawings and claims, is incorporated hereby by reference in its entirety and made a part of this specification.

A. HE Gripper Assembly

The HE gripper assembly can be a stand alone subassembly that can be preferably configured to be adaptable to substantially all applicable tractor designs. In some embodiments, a spring return, single acting hydraulic cylinder actuator 20 can provide an axial force to the linkage 12 to translate into radial force. In some embodiments, a second spring return, single acting hydraulic cylinder actuator 220 can provide an axial force to the linkage 12 to translate into radial force. As with certain previous grippers, the HE gripper may allow axial translation of a tractor shaft while the gripping section 14 engages the hole or casing wall.

With reference to FIG. 1, in some embodiments, the HE gripper assembly 10 can comprise three subassemblies: a power section or actuator 20, a second power section or actuator 220, and an expandable gripping section 14. For ease of discussion, these subassemblies are discussed separately below. However, it is contemplated that in other embodiments of HE gripper, more subassemblies can be present or the actuator 20, actuator 220, and expandable gripping section 14 can be integrated such that it is difficult to consider each as separate subassemblies. As used herein, "actuator" and "expandable gripper assembly" are broad terms and include integrated designs. Furthermore, in some embodiments an expandable gripping section 14 can be provided apart from an actuator 20 or an actuator 220 such that the expandable gripping section 14 of the HE gripper 10 described herein can be fit to existing actuators of existing tractors, for example single or double acting hydraulic piston actuators, electric motors, or other actuators.

Figure 3:
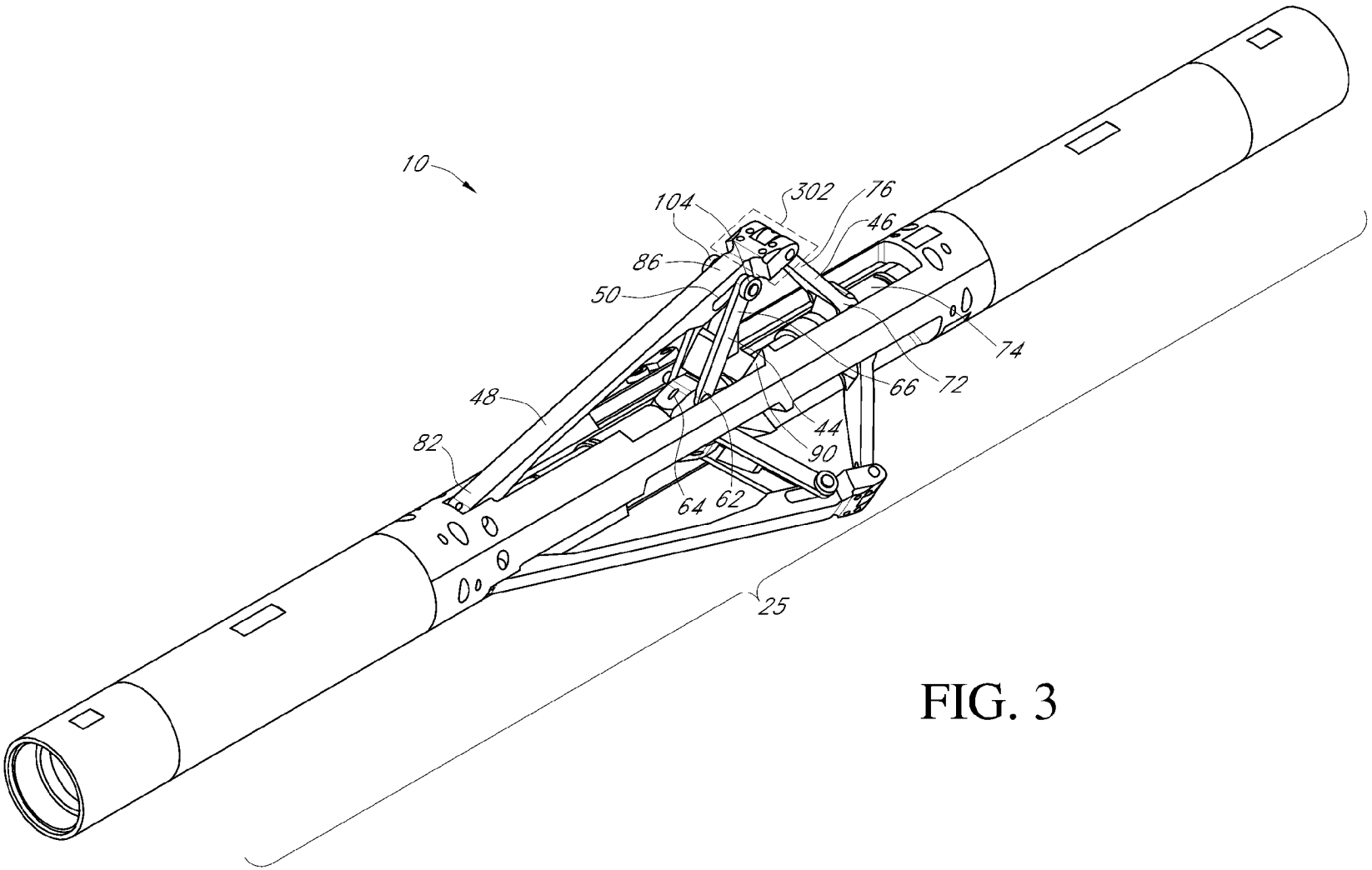
FIG. 3 is a perspective view of the linkage of one embodiment of the gripper assembly of FIG. 1 in an expanded state.
Figure 9:
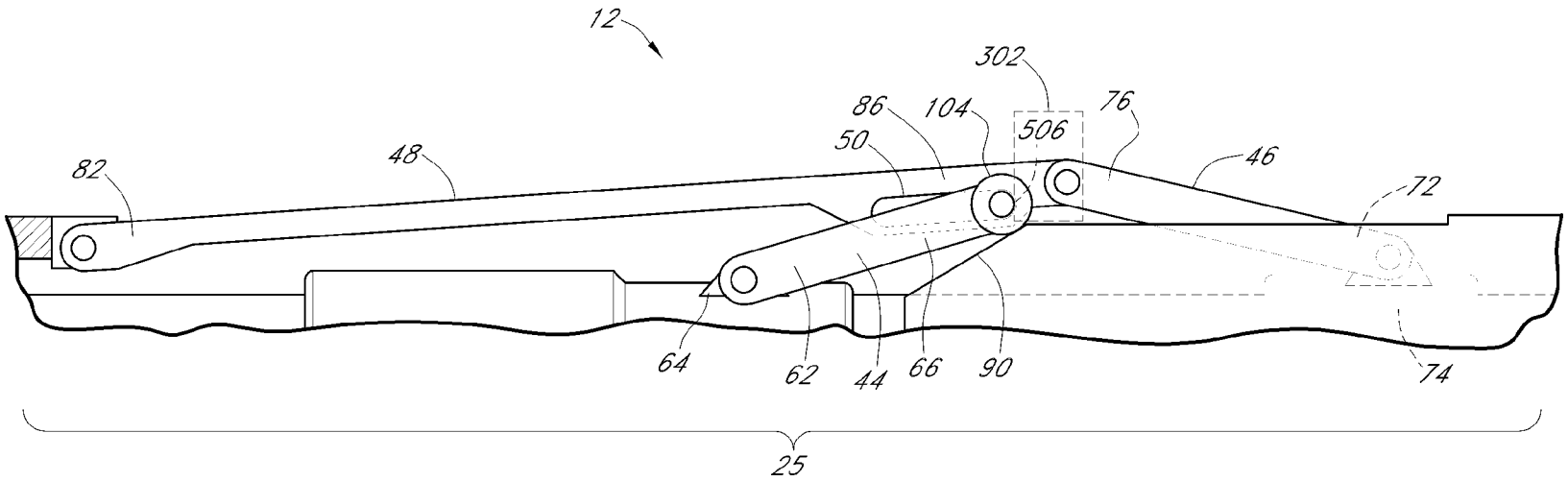
FIG. 9 is a schematic view of the linkage of FIG. 1 in a first stage of expansion.

With particular reference to FIGS. 3 and 9, in the illustrated embodiment, the linkage 12 of the gripping section 14 includes a linkage 12 comprising a first or short lift link 44, a second or longer lift link 46, and a third or tension link 48. The links 46, 48 are rotatably connected to one another in series, such as by a pinned connection. In the illustrated embodiments, a first end 62 of the short lift link 44 is rotatably coupled to an elongate body 25 defining the expandable gripping section 14 at a short lift link support 64, such as by a pinned connection. The short lift link support 64 can be axially slideable with respect to the elongate body 25 along a distance of the body. A second end 66 of the short lift link 44 may comprise a shaft connecting two rollers 104. The shaft may be disposed within a slot 50 located near a second end 86 of the tension link 48 such that the shaft is free to slide within the slot 50. In the illustrated embodiments, a first end 72 of the longer lift link 46 is rotatably coupled to an elongate body 25 defining the expandable gripping section 14 at a longer lift link support 74, such as by a pinned connection. The longer lift link support 74 can be axially slideable with respect to the elongate body 25 along a distance of the body. A first end 82 of the tension link 48 may be rotatably coupled to the elongate body 25 such as by a pinned connection.

With reference to FIGS. 3 and 9, at the rotatable connection of the longer lift link 46 to the tension link 48, there can be an interference mechanism 302 configured to maintain contact with the formation of a well bore or passage. This interference mechanism 302 transfers the radial expansion force generated through the mechanism into the interior surface of the well bore or passage. In other embodiments, the interference mechanism 302 can interact with an elongated toe assembly or continuous beam that interacts with the interior surface of the well bore or passage. As shown in the illustrated embodiments, the interference mechanism 302 can include a plurality of gripping elements 304 disposed on outer surfaces of one or more of the links, preferably near the pinned connection between the longer lift link 46 and the tension link 48. In some embodiments, including the illustrated embodiment, the interference mechanism 302 can be located on the tension link 48 to allow a small contact area between the gripper assembly 10 and the wellbore formation.

With continued reference to FIGS. 3 and 9, the rollers 104 are configured to roll in contact with a ramp 90 during a portion of the expansion of the HE gripper assembly 10. However, in the illustrated embodiment, the roller will only be in contact with the ramp 90 during a portion of the expansion process, as further described below.

In other embodiments including the illustrated embodiment, a linkage gripper assembly as disclosed herein could incorporate a continuous flexible beam. The linkage gripping section 14 could act on an interior surface of the continuous flexible beam such that the outer surface of the continuous flexible beam interacts with the interior surface of a well bore or passage. The continuous beam, preferably having a substantially featureless outer surface, may be less prone to becoming stuck on well bore irregularities.

In some embodiments, as illustrated in FIGS. 3-7, the HE gripper assembly 10 can include three sets of linkages 12 substantially evenly spaced circumferentially about the body. In other embodiments, the HE gripper assembly 10 can include more or fewer than three sets of linkages 12 such as for example one, two, or four sets of linkages. In some embodiments, the gripping section 14 is configured such that the minimum expansion force exerted by each linkage 12 is greater than approximately 500 pounds and desirably greater than approximately 1,000 pounds over the entire range of expansion of the gripper. In some embodiments, the gripping section 14 is configured so each linkage 12 can expand to desirably greater than seven inches diameter and preferably approximately twelve inches in diameter. The combinations of expansion mechanisms of the HE gripper assembly 10 embodiments described herein can limit the force output, while still maintaining sufficient expansion force to grip a casing over a wide range of expansion diameters. Desirably, the limitation of force output can reduce the risk of overstressing the components of the HE gripper during the full range of expansion.

With respect to FIGS. 2A-B, a cross-sectional view of an embodiment of actuators 20 and 220 of the HE gripper assembly 10 are illustrated. In the illustrated embodiment, the actuators 20 and 220 comprise single acting, spring return hydraulically powered cylinders. Preferably, a single hydraulic source actuates each actuator 20 and 220. Desirably, hydraulic fluid will flow from a single hydraulic source into the piston actuating the link with the least amount of resistance. Thus, in the illustrated embodiment, the piston 22 can be longitudinally displaced within the cylinder 30 by a pressurized fluid acting on the piston 22. Pressurized fluid media is delivered between a gripper connector 32 and the piston 22. The fluid media acts upon an outer diameter of the mandrel 34 and an internal diameter of the gripper cylinder 30, creating a piston force. Referring to FIGS. 2A-B and 3, the piston force acts upon the piston 22 with enough force to axially deform a return spring 26. The piston 22 is connected to a piston rod 24 which acts on the support 64 to which the short lift link 44 is connected, to buckle the short lift link 44 and expand the linkage, as illustrated in FIG. 3. The piston 22 can continue axial displacement with respect to the mandrel 34 with an increase in pressure of the supplied fluid until an interference surface 38 defining a stroke limiting feature of the piston rod 24 makes contact with a linkage support 40. In the illustrated embodiment shown in FIG. 2A, the tension link 48, partially seen, is rotatably coupled to the linkage support 40 such as by a pinned connection. In the illustrated embodiment, the gripper connector 32 and linkage support 40 are connected to each other via the gripper cylinder 30. In other embodiments, including the illustrated embodiment, a second actuator 220 may be provided such that force is applied to the support 74 of the longer lift link 46 in order to buckle the second lift link 46 and expand the linkage, as shown in FIG. 2B. Similarly to the action described above with respect to actuator 20, actuator 220 acts on the support 74 to which the longer lift link 46 is connected, to buckle the longer lift link 46 and expand the linkage, also as shown in FIG. 3. In other embodiments, a single actuator 20 acts to buckle the short lift link 44 and the longer lift link 46 to expand the linkage.

In other embodiments, the actuators 20 and 220 can comprise other types of actuators such as dual acting piston/cylinder assemblies or an electric motor. The actuators 20 and 220 can create a force (either from pressure in hydraulic fluid or electrically-induced rotation) and convey it to the expandable gripping section 14. In other embodiments, the expandable gripping section 14 can be configured differently such that the gripping section 14 can have a different expansion profile.

Figure 4:
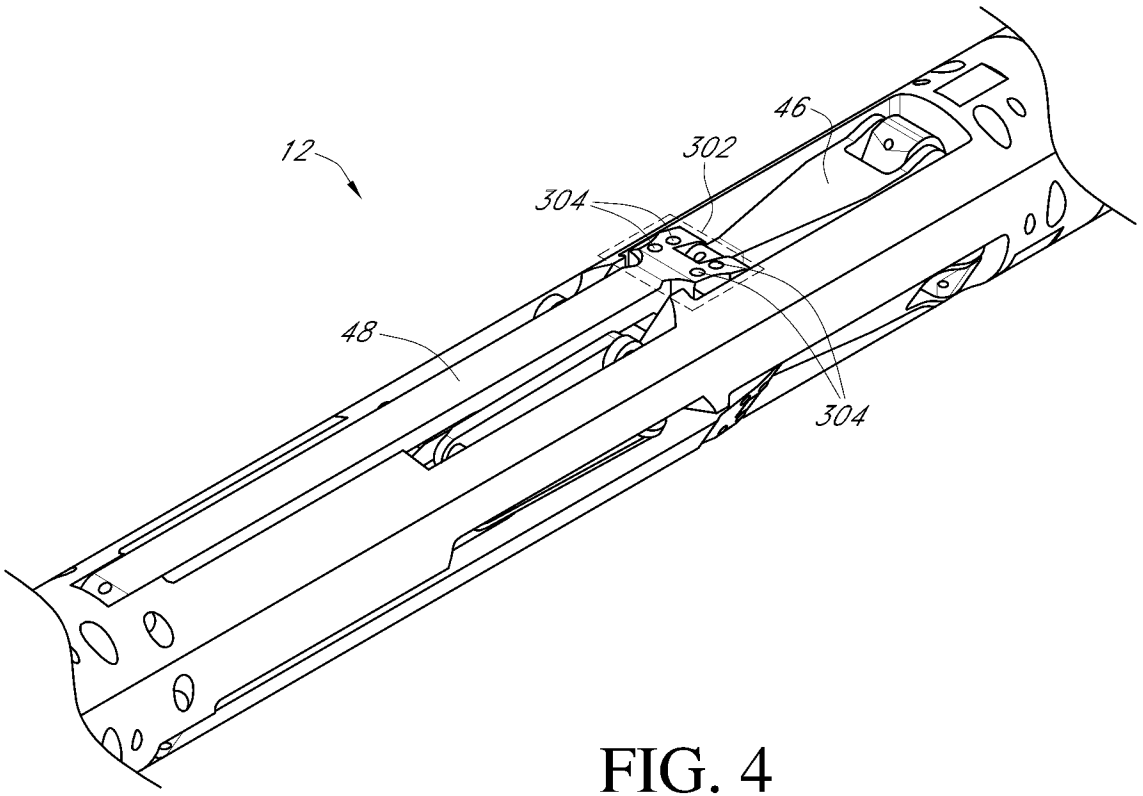
FIG. 4 is a perspective view of the linkage of one embodiment of the gripper assembly of FIG. 1 in a collapsed state.

FIGS. 1 and 4 illustrate an embodiment of the HE gripper assembly 10 in a collapsed configuration. When the illustrated embodiment of the HE gripper assembly 10 is incorporated in a tractor, an elongate body 25 or mandrel of the tractor is attached to the gripper connector 32 and a mandrel cap 60. The HE gripper 10 includes an internal mandrel 34 which extends between the gripper connector 32 and the mandrel cap 60 during the expansion process and can provide a passage for the pressurized fluid media to the actuator 20 when the piston is positioned within the cylinder (FIG. 2) at any location along the mandrel 34. In the illustrated embodiment, the piston rod 24 connects the actuator 20 to the expandable gripping section 14 of the HE gripper assembly 10.

In the illustrated embodiment, when the HE gripper assembly 10 is expanded, as shown in FIG. 3, the expandable gripping section 14 converts the axial piston force of the actuator 20 to radial expansion force. The linkage 12 expands, transmitting the radial expansion force to the formation or casing of a bore hole or passage. In some embodiments, the linkage 12 may act on an interior surface of a continuous beam that can then apply the radial expansion force onto a formation or casing of a bore hole.

B. Operation Description of the HE Gripper

With reference to FIGS. 1, 2A-B, 4, and 8, in the illustrated embodiments, the HE gripper assembly 10 is biased into a collapsed state. When pressure is not present in the actuator 20, the return spring 26 can exert a tensile force on the link members 44, 46, 48. This tensile force can keep the links 44, 46, 48 in a flat position substantially parallel to the elongate body 25 of the HE gripper assembly 10.

An expansion sequence of the HE gripper assembly 10 from a fully collapsed or retracted position to a fully expanded position is illustrated sequentially in FIGS. 4-12. FIGS. 1 and 4 illustrate an embodiment of the HE gripper assembly 10 in a collapsed state. As discussed above, in the illustrated collapsed position, the linkage 12 is biased into a flat position substantially parallel to the elongate body 25 of the HE gripper assembly 10.

Figure 5:
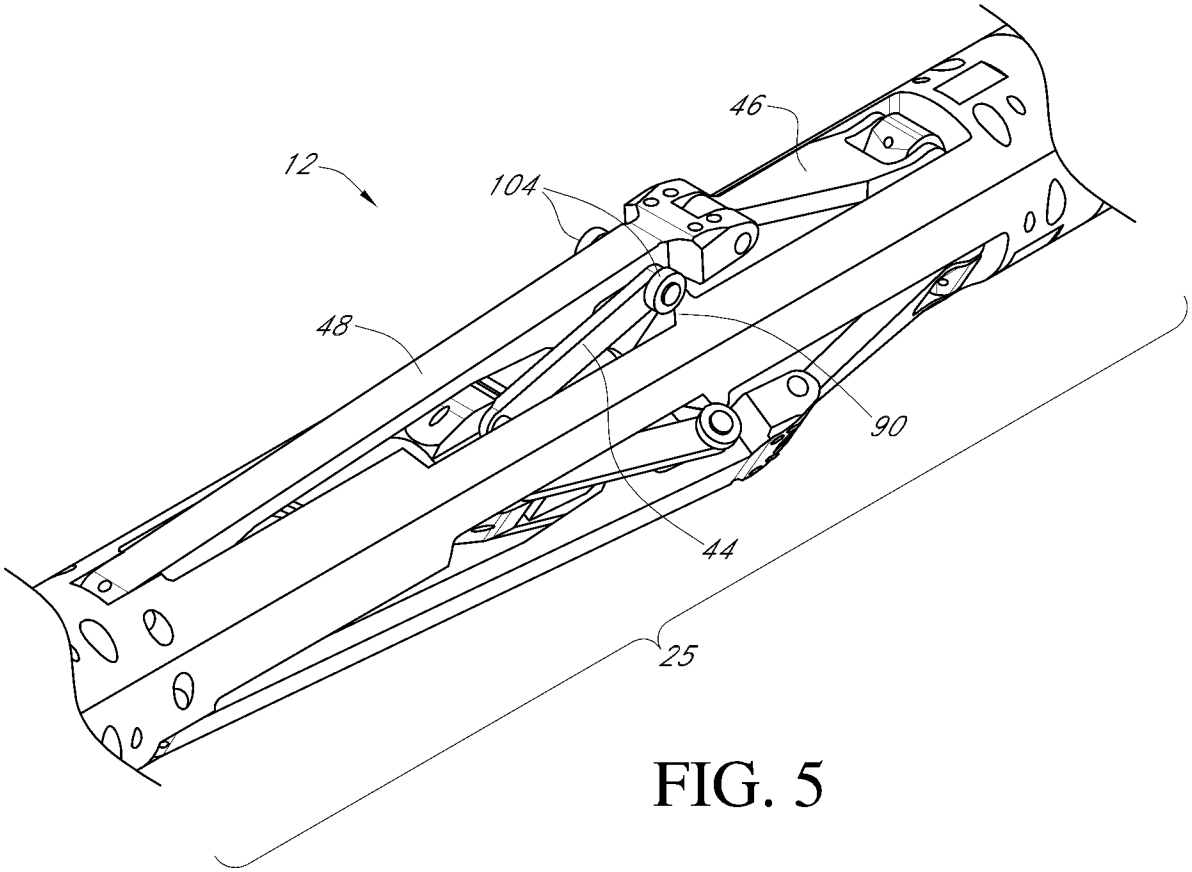
FIG. 5 is a perspective view of the linkage of one embodiment of the gripper assembly of FIG. 1 in a first stage of expansion.
Figure 6:
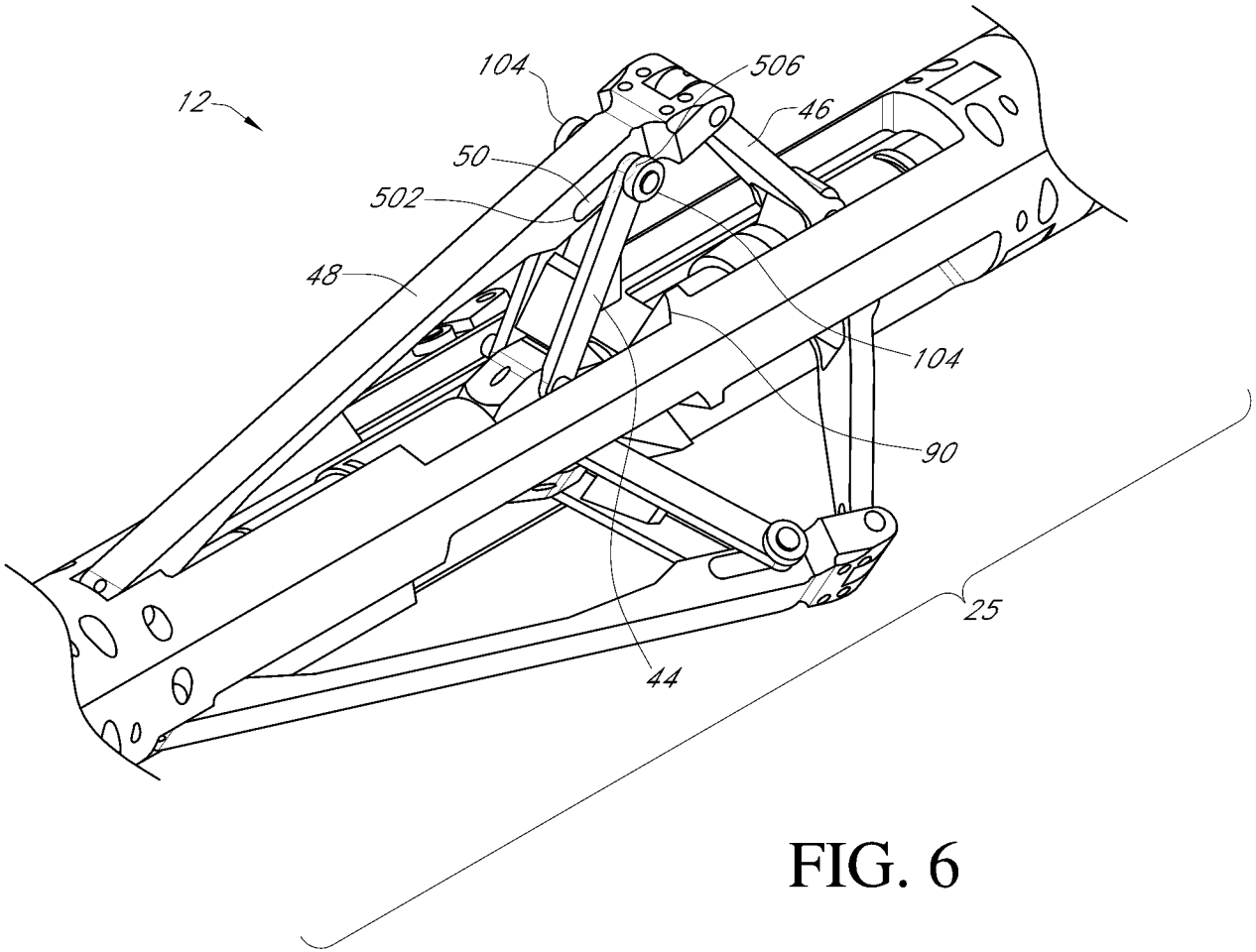
FIG. 6 is a perspective view of the linkage of one embodiment of the gripper assembly of FIG. 1 in a second stage of expansion.
Figure 7:
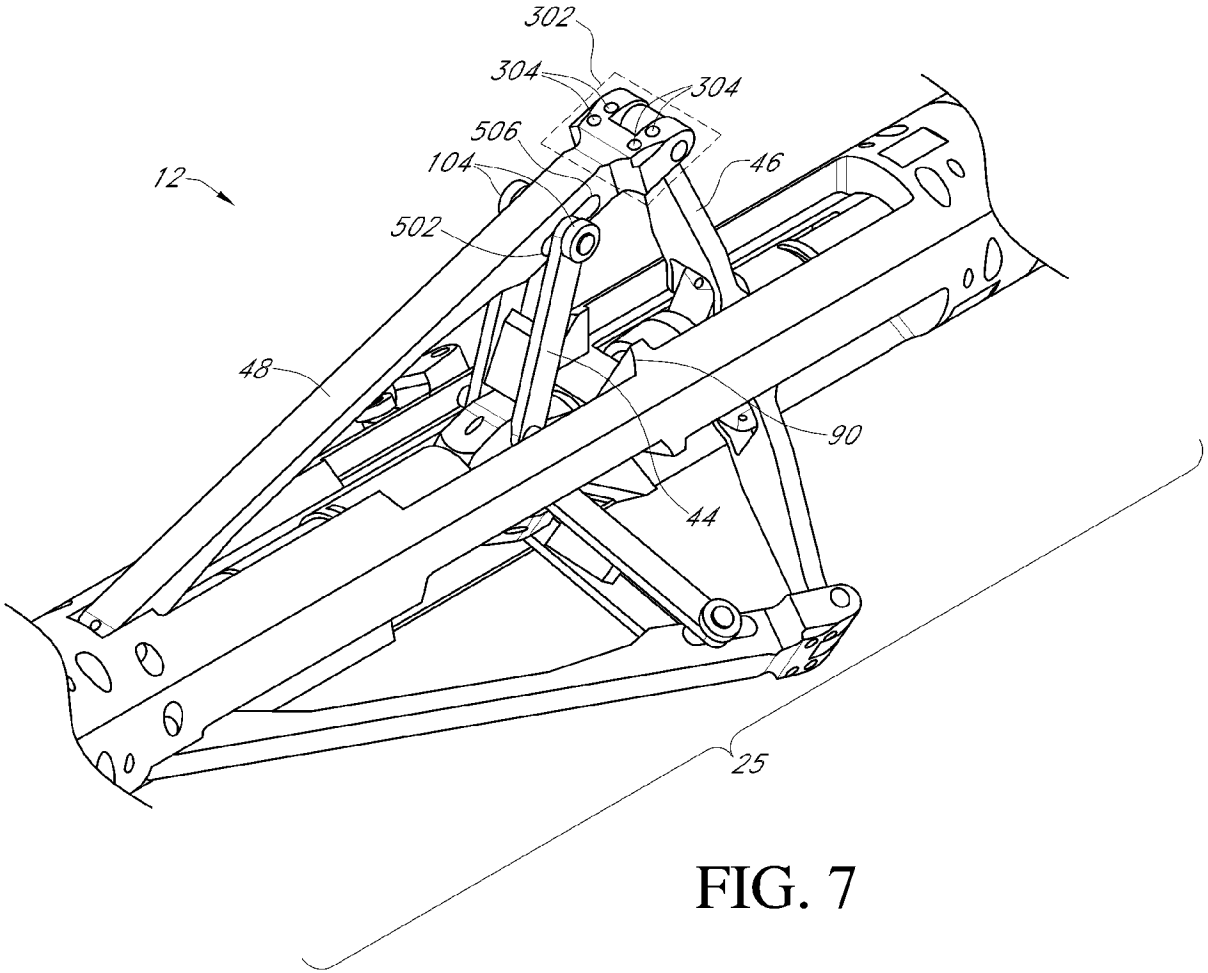
FIG. 7 is a perspective view of the linkage of one embodiment of the gripper assembly of FIG. 1 in a third stage of expansion.
Figure 8:
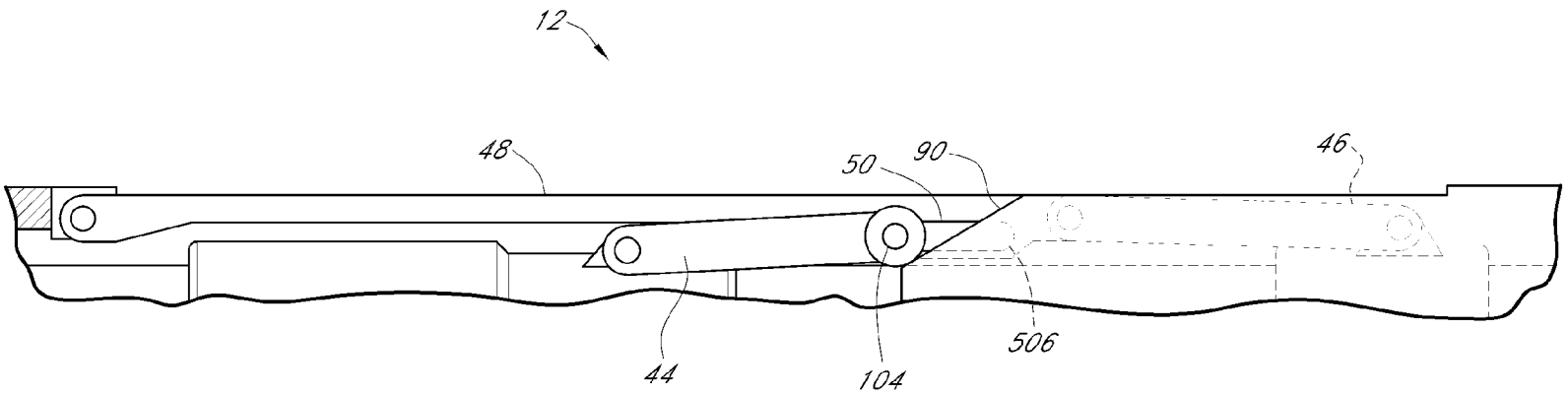
FIG. 8 is a schematic view of the linkage of FIG. 1 in a collapsed state.

An embodiment of the HE gripper assembly 10 in a first stage of expansion is illustrated in FIGS. 5 and 9. With reference to FIGS. 5 and 9, in some embodiments, the expansion surface comprises an inclined ramp 90 having a substantially constant slope. In other embodiments, the expansion surface can comprise a curved ramp having a slope that varies along its length. As shown in FIGS. 5 and 9, as the actuator 20 axially translates the piston rod 24, the rollers 104 of the short lift link 44 are advanced up the ramp 90 of the expansion surface. As illustrated, the shaft connecting the rollers 104 bears on a second end 506 of the slot 50 disposed in the second end 86 of the tension link 48, expanding the tension link 48 radially outward. Similarly, actuator 220 axially translates piston rod 224 such that the first end 72 of the second, or longer, lift link 46 is axially translated, resulting in buckling of the longer lift link 46 and expansion of the tension link 48 radially outward. When the HE gripper assembly 10 is expanded in a wellbore formation or casing, the second end 86 of the tension link 48 via the interference mechanism 302 can apply the radial expansion force to the formation or casing wall. During this initial phase of expansion, preferably substantially all of the radial expansion forces generated by the HE gripper assembly 10 are borne by the rollers 104 rolling on the ramp 90. In some embodiments, including the illustrated embodiment, the elongate body 25 and ramp 90 are desirably configured such that debris is not trapped within the elongate body 25 and around and upon the ramp 90 in such a way as to interfere with the roller-ramp operation of the gripper assembly 10.

Figure 10:
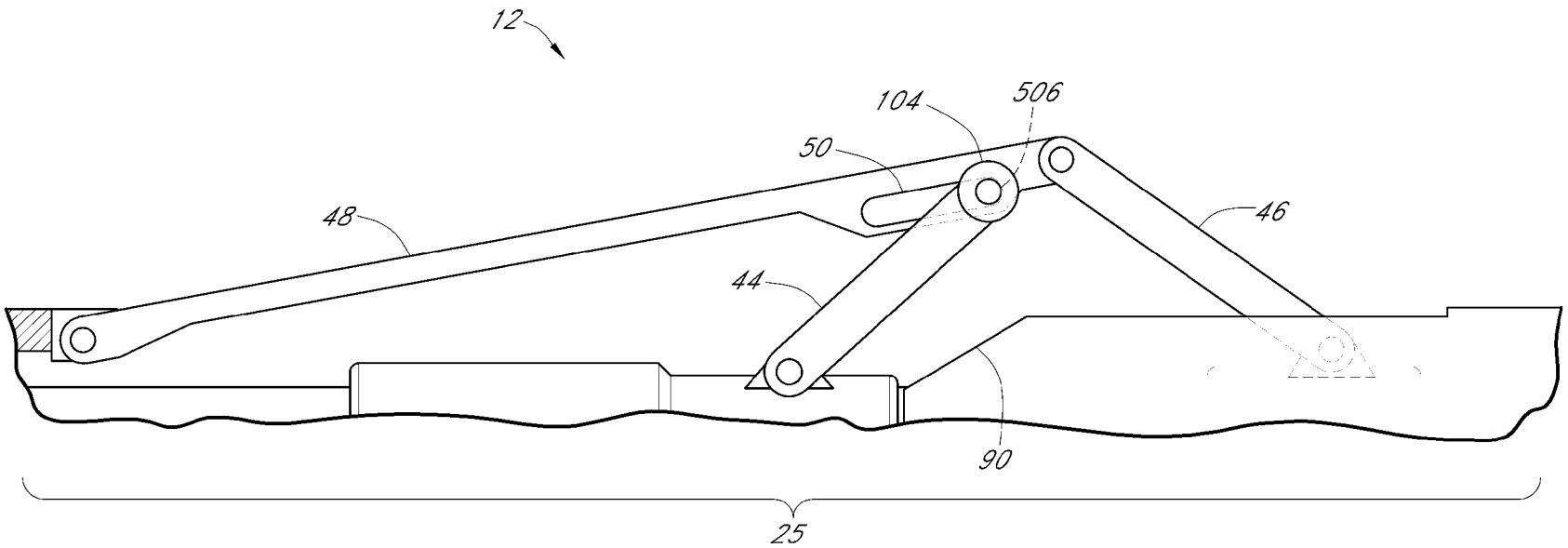
FIG. 10 is a schematic view of the linkage of FIG. 1 in a second stage of expansion.
Figure 11:
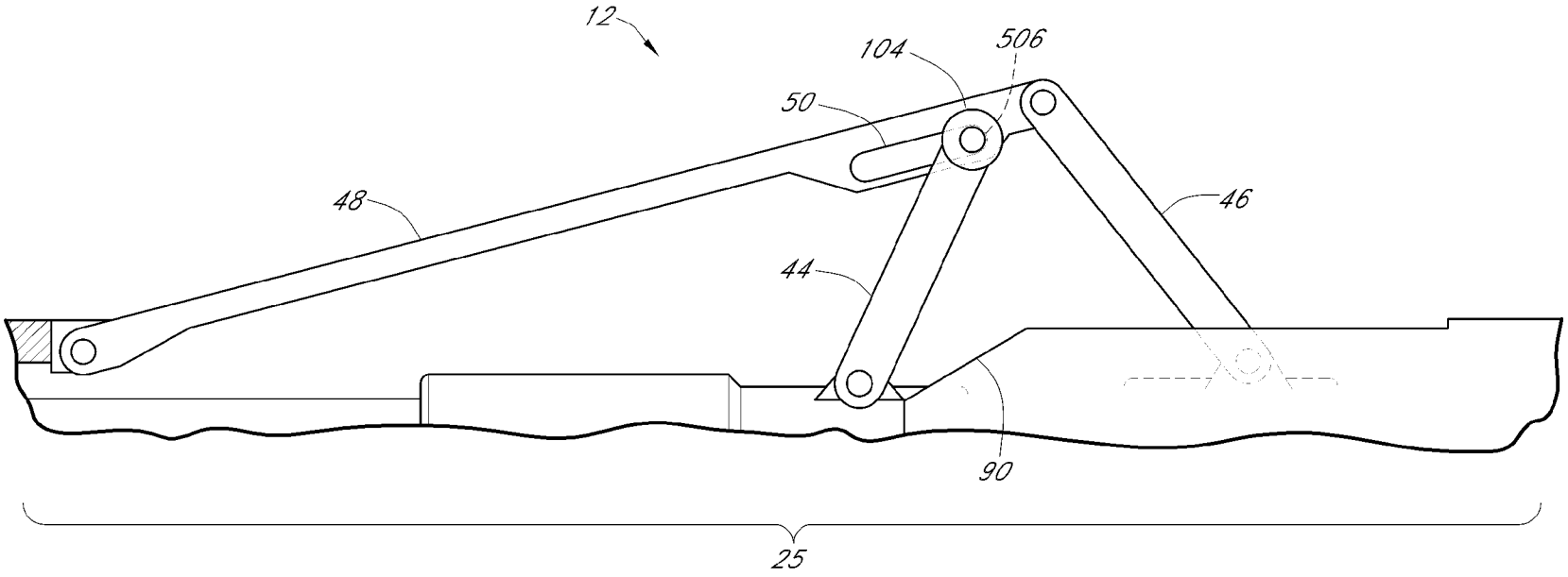
FIG. 11 is a schematic view of the linkage of FIG. 1 in a third stage of expansion.

In the illustrated embodiments, the initial phase of expansion described above with respect to FIG. 5 can continue until the actuator 20 advances the piston rod 24 such that the rollers 104 reach an expanded end of the ramp 90. FIG. 9 illustrates the expandable gripping section 14 of the HE gripper assembly 10 expanded to a point where the rollers 104 have reached an expanded end of the ramp 90, and a second stage of expansion is set to begin, as illustrated in FIG. 10. Once the rollers 104 have reached the expanded end of the ramp 90, the actuator 20 desirably continues to exert force on the short lift link 44 and the longer lift link 46 via axial translation of the piston rod 24. Continued application of force by the actuator 20 further radially expands and buckles the links 44, 46, 48 with respect to the elongate body 25. Desirably, the short lift link 44 continues to act on the second end 506 of the slot 50 in order to radially expand the tension link 48, as shown in FIGS. 10 and 11. In the illustrated embodiment, this continued expansion of the linkage 12 radially expands the linkage such that the HE gripper assembly 10 can apply a radial expansion force to a formation or casing wall. Desirably in this stage of expansion, the short lift link 44 is preferably at a larger angle with the body than the longer lift link 46. Therefore, desirably the short lift link 44 provides a greater lifting force for the linkage 12 at this stage of expansion.

With reference to FIG. 11, further expansion of the expandable assembly is illustrated. In this stage of expansion, the continued buckling of the short lift link 44 and longer lift link 46 away from the HE gripper assembly 10 body has radially expanded the tension link 48. The short lift link 44 preferably continues to act against the second end 506 of the slot 50 within the tension link 48 to radially expand the linkage. At this stage of expansion, desirably the short lift link 44 reaches an angle between 60-85 degrees from the elongate body and the piston providing force to activate the short lift link 44 desirably reaches the end of its stroke. In some embodiments, including the illustrated embodiment, maximum expansion due to buckling of the short lift link 44 desirably occurs when the link 44 reaches an angle between 50 and 90 degrees, more desirably between 55 and 90 degrees, and even more desirably between 60 and 85 degrees, as measured from the elongate body. In some embodiments, including the illustrated embodiment, maximum expansion due to buckling of the short lift link 44 desirably occurs when the link 44 is at an angle of at least 50 degrees, more desirably when the link 44 is at an angle of at least 60 degrees, and most desirably when the link 44 is at an angle of at least 70 degrees, as measured from the elongate body. In some embodiments, including the illustrated embodiment, maximum expansion due to buckling of the short lift link 44 desirably occurs when the link 44 is at a maximum angle of 75 degrees, more desirably when the link 44 is at a maximum angle of 80 degrees, or most desirably when the link 44 is at a maximum angle of 85 degrees, as measured from the elongate body. Preferably at this stage of expansion, the longer lift link 46 desirably is at an angle from the elongate body such that the longer lift link 46 can provide additional expansion force.

Figure 12:
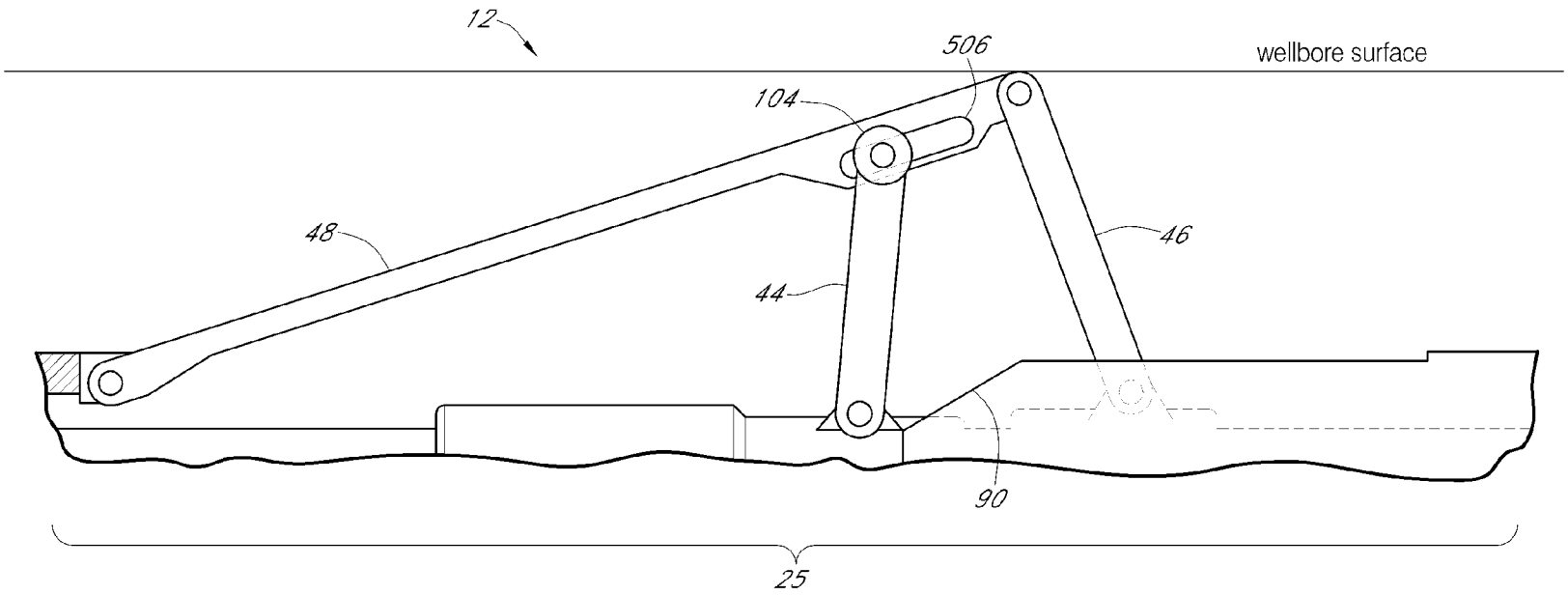
FIG. 12 is a schematic view of the linkage of FIG. 1 in a fourth stage of expansion.

FIG. 12 illustrates further expansion of the expandable assembly. In this stage of expansion, the continued buckling of the tension link 48 is due to the force exerted by the actuator 20 on the longer lift link 46. Desirably, the short lift link 44 no longer provides expansion force and the shaft connecting the rollers 104 is free to move within the slot 50, therefore no longer acting against the second end 506 of the slot 50. When the longer lift link 46 desirably reaches an angle of 60 to 85 degrees as measured from the elongate body, the piston providing force to activate the longer lift link 46 desirably reaches the end of its stroke. Maximum expansion of the linkage due to the buckling of the longer lift link 46 desirably occurs when the link 46 reaches an angle between 50 and 90 degrees, more desirably between 55 and 90 degrees, and even more desirably between 60 and 85 degrees, as measured from the elongate body. In some embodiments, including the illustrated embodiment, maximum expansion due to buckling of the longer lift link 46 desirably occurs when the link 46 is at an angle of at least 50 degrees, more desirably when the link 46 is at an angle of at least 60 degrees, and most desirably when the link 46 is at an angle of at least 70 degrees, as measured from the elongate body. This position desirably represents the maximum possible expansion diameter of the gripper assembly.

The configuration of the linkage 12 and the relative lengths of the links 44, 46, 48, and the position and height of the ramp 90 can determine the expansion ranges for which the primary mode of expansion force transfer is through the ramp 90 to rollers 104 interface and the expansion range for which the primary expansion force is generated by the buckling of the links 44, 46, 48 by the piston rod of the actuator 20.

In some embodiments, where the HE gripper assembly 10 can be used for wellbore intervention in boreholes having relatively small entry points and potentially large washout sections, it can be desirable that a collapsed outer diameter of the HE gripper assembly 10 is approximately 3 inches and an expanded outer diameter is approximately 15 inches, thus providing a total diametric expansion, defined as a difference between the expanded outer diameter and the collapsed outer diameter, of approximately 12 inches. In some embodiments, including the illustrated embodiment, the total diametric expansion of the gripper assembly 10 can be at least 10 inches, at least 12 inches, or at least 15 inches. Desirably, in some embodiments, including the illustrated embodiment, an expansion range (that is, the distance between the outer diameter of the gripper assembly 10 in a collapsed state and the outer diameter of the gripper assembly 10 in an expanded state) can be between 2 inches and 5 inches, between 2 inches and 6 inches, between 3 inches and 5 inches, between 3 inches and 6 inches, between 3 inches and 7 inches, between 3 inches and 8 inches, between 3 inches and 10 inches, between 3 inches and 12 inches, between 3 inches and 15 inches or between 3 inches and 18 inches. In some embodiments, including the illustrated embodiment, the HE gripper assembly 10 can have an outer diameter in a collapsed position of less than 5 inches, less than 4 inches, or less than 3.5 inches. In some embodiments, including the illustrated embodiment, the HE gripper assembly 10 can have an outer diameter in an expanded position of at least 10 inches, at least 12 inches, at least 15 inches, or at least 17 inches. In certain embodiments, it can be desirable that an expansion ratio of the HE gripper assembly 10, defined as the ratio of the outer diameter of the HE gripper assembly 10 in an expanded position to the outer diameter of the HE gripper assembly 10 in a collapsed position, is at least 6, at least 5, at least 4.2, at least 4, at least 3.4, at least 3, at least 2.2, at least 2, at least 1.8 or at least 1.6. Desirably, in some embodiments, including the illustrated embodiment, the HE gripper assembly 10 has an expansion ratio of at least one of the foregoing ranges and a collapsed position to allow the gripper assembly 10 to fit through a wellbore opening having a diameter no greater than 7 inches, a diameter no greater than 6 inches, a diameter no greater than 5 inches, or a diameter no greater than 4 inches. Desirably, in some embodiments, including the illustrated embodiment, the HE gripper assembly 10 has an expansion ratio of at least 3.5 and a collapsed position to allow the gripper assembly 10 to fit through a wellbore opening having a diameter no greater than 7 inches, a diameter no greater than 6 inches, a diameter no greater than 5 inches, or a diameter no greater than 4 inches.

It can be desirable that in certain embodiments, the ramp has a height at the expanded end thereof relative to the HE gripper assembly 10 body from between approximately 0.3 inches to approximately 1 inch, and more desirably from 0.4 inches to 0.6 inches, such that for a diameter of the HE gripper assembly 10 from approximately 3.7 inches to up to approximately 5.7 inches, and desirably, in some embodiments, up to approximately 4.7 inches, the primary mode of expansion force transfer is through the rollers 104 to ramp 90 interface. At expanded diameters greater than approximately 5.7 inches, or, in some embodiments desirably approximately 4.7 inches, the primary mode of expansion force transfer is by continued buckling of the linkage 12 from axial force applied to the first ends 62 and 72 of the links 44 and 46, respectively.

In the illustrated embodiments and as discussed above, the short lift link 44 and the longer lift link 46 are desirably of different lengths so that preferably the shaft connecting the rollers 104 at the second end 66 of the short lift link 44 is allowed to freely move within the slot 50 and at greater expansion ranges no longer provides force to radially expand the linkage. When the radial expansion of the linkage reaches a point where the short lift link 44 no longer provides radial expansion force, the longer lift link 46 desirably provides additional radial expansion force to expand the linkage. In some embodiments, including the illustrated embodiment, the ratio of the length of the short lift link 44 to the longer lift link 46 is greater than 0.5, desirably greater than 0.7, and, more desirably greater than 0.85. In some embodiments, including the illustrated embodiment, the ratio of the length of the short lift link 44 to the longer lift link 46 is less than 3, desirably less than 2, and most desirably, less than 1.

In other embodiments, including the illustrated embodiment, shown in FIGS. 14-18, the short lift link 44 may comprise two sections rotatably joined together, such as by a pinned connection. As shown in FIG. 14A, this "elbow link" 140 is desirably comprised of two sections 142 and 144 preferably rotatably joined by a pinned connection. The two sections 142 and 144 desirably allow the effective length of the link to vary from short to long as the angle A between the two sections increases, as shown in the expansion series depicted in FIGS. 14-18. As the elbow link 140 reaches a certain angle due to buckling of the link, stops 146 within the elbow link desirably maintain the link angle A between the two sections. This desirably allows the translation of additional compressive force through the link 140 as the first section 142 of the link acts as a short lift link and later, at further ranges of expansion, both sections 142 and 144 act together as a short lift link, as discussed above. Similar to the short lift link 44 discussed above, the elbow link 140 may also comprise rollers 104 disposed on a shaft in a second end of the first section 142 of the elbow link 140. The action of the rollers 104 is similar to that of the rollers 104 discussed above.

Figure 14:
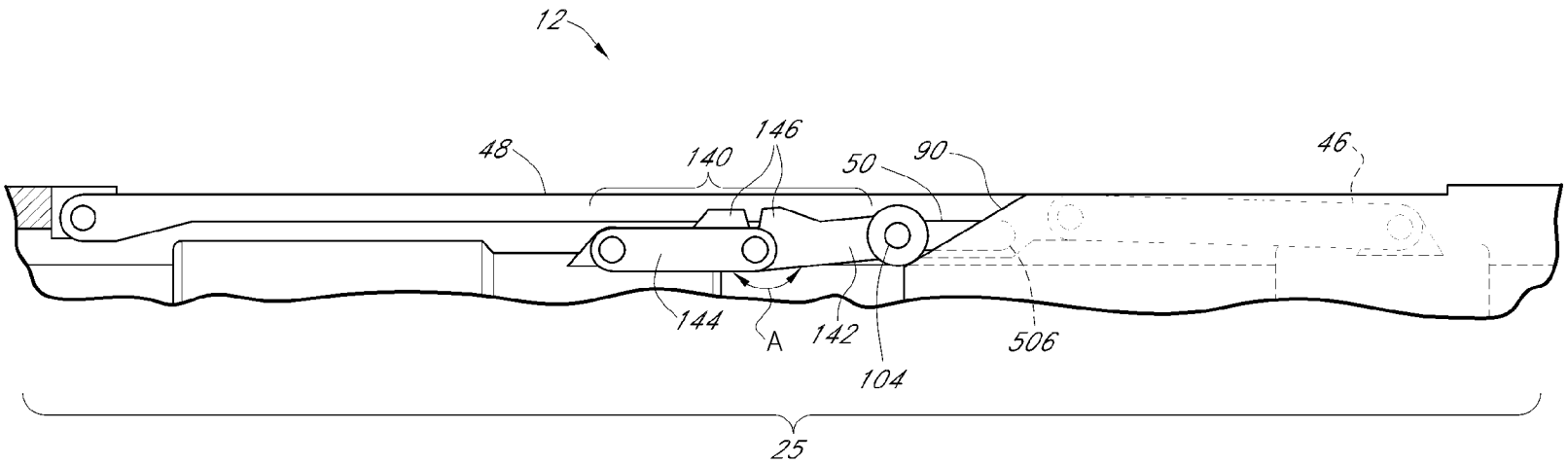
FIG. 14 is a schematic view of another embodiment of the invention in a collapsed state.
Figure 14A:
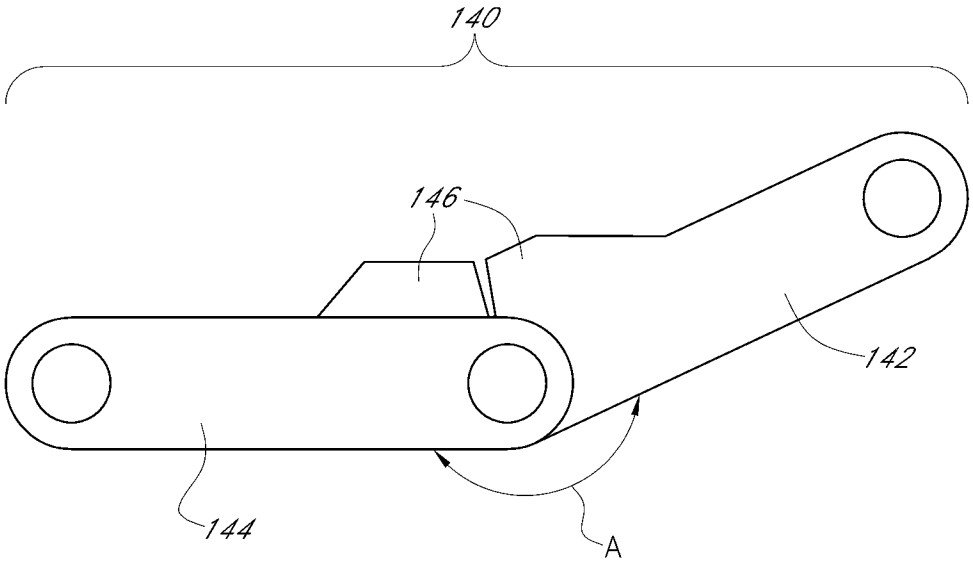
FIG. 14A is a schematic view of an elbow linkage.

In FIG. 14, the HE gripper assembly 10 with an "elbow link" 140 is shown in a collapsed state. In this state, the angle A between the two sections 142 and 144 of the elbow link 140 is desirably 180 degrees. In other embodiments, including the illustrated embodiment, the angle A may desirably be between 170 and 200 degrees, more desirably between 175 and 190 degrees, and most desirably between 178 and 185 degrees when the linkage is in a collapsed state such as that shown in FIG. 14.

Figure 15:
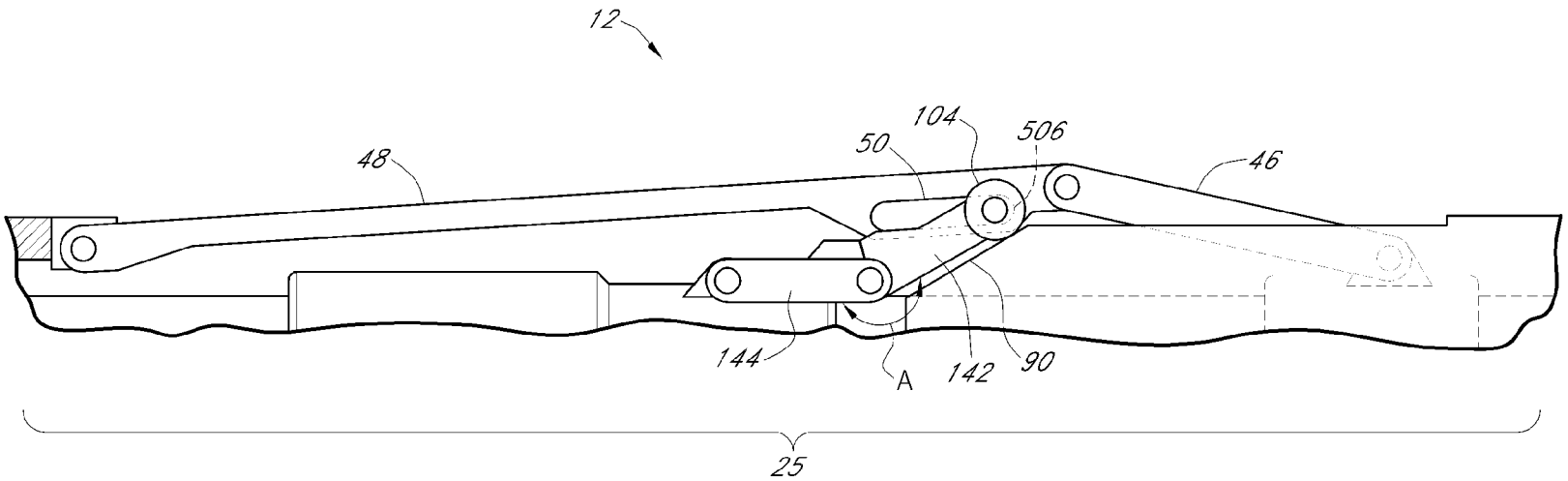
FIG. 15 is a schematic view of the linkage of FIG. 14 in a first stage of expansion.

With reference to FIG. 15, an embodiment of the HE gripper assembly 10 in a first stage of expansion is illustrated, similar to that discussed above in reference to FIGS. 5 and 9. As shown in FIG. 15, as the actuator 20 axially translates the piston rod 24, the rollers 104 of the elbow link 140 are advanced up the ramp 90 of the expansion surface. As illustrated, the shaft connecting the rollers 104 bears on a second end 506 of the slot 50 disposed in the second end 86 of the tension link 48, expanding the tension link 48 radially outward. Similarly, actuator 20 axially translates piston rod 24 such that the first end 72 of the second, or longer, lift link 46 is axially translated, resulting in buckling of the longer lift link 46 and expansion of the tension link 48 radially outward. When the HE gripper assembly 10 is expanded in a wellbore formation or casing, the second end 86 of the tension link 48 via the interference mechanism 302 can desirably apply the radial expansion force to a small contact area of the formation or casing wall. During this initial phase of expansion, preferably substantially all of the radial expansion forces generated by the HE gripper assembly 10 are borne by the rollers 104 rolling on the ramp 90. Preferably, during this stage of expansion, the section 142 of the elbow link 140 acts a shorter lift link.

Figure 16:
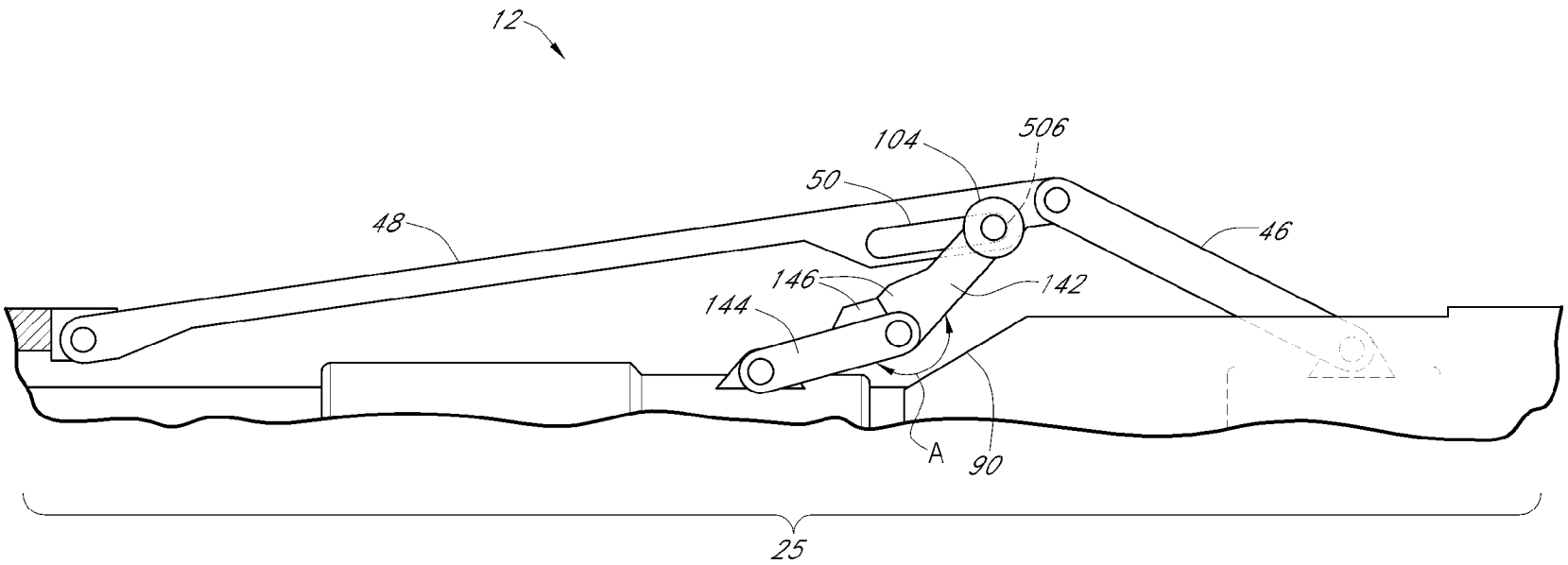
FIG. 16 is a schematic view of the linkage of FIG. 14 in a second stage of expansion.

In the illustrated embodiments, the initial phase of expansion described above with respect to FIG. 15 can continue until the actuator 20 advances the piston rod 24 such that the rollers 104 reach an expanded end of the ramp 90. FIG. 15 illustrates the expandable gripping section 14 of the HE gripper assembly 10 expanded to a point where the rollers 104 have reached an expanded end of the ramp 90, and a second stage of expansion is set to begin, as illustrated in FIG. 16. Once the rollers 104 have reached the expanded end of the ramp 90, the actuator 20 desirably continues to exert force on the elbow link 140 and the longer lift link 46 via axial translation of the piston rod 24. Continued application of force by the actuator 20 further radially expands and buckles the links 140, 46, 48 with respect to the HE gripper assembly 10 body. Desirably, the elbow link 140 continues to act on the second end 506 of the slot 50 in order to radially expand the tension link 48, as shown in FIGS. 15 and 16. In the illustrated embodiment, this continued expansion of the linkage 12 radially expands the linkage such that the HE gripper assembly 10 can apply a radial expansion force to a formation or casing wall. Desirably in this stage of expansion, the elbow link 140 is preferably at a higher angle than the longer lift link 46. Therefore, desirably the elbow link 140 provides a greater lifting force for the linkage 12 at this stage of expansion. Preferably, during the expansion range illustrated between FIGS. 15 and 16, the two sections 142 and 144 of the elbow link 140 reach their maximum angle A and are prevented from further rotation by stops 146. At this point, the elbow link 140 acts as a single link providing force to radially expand the linkage.

Figure 17:
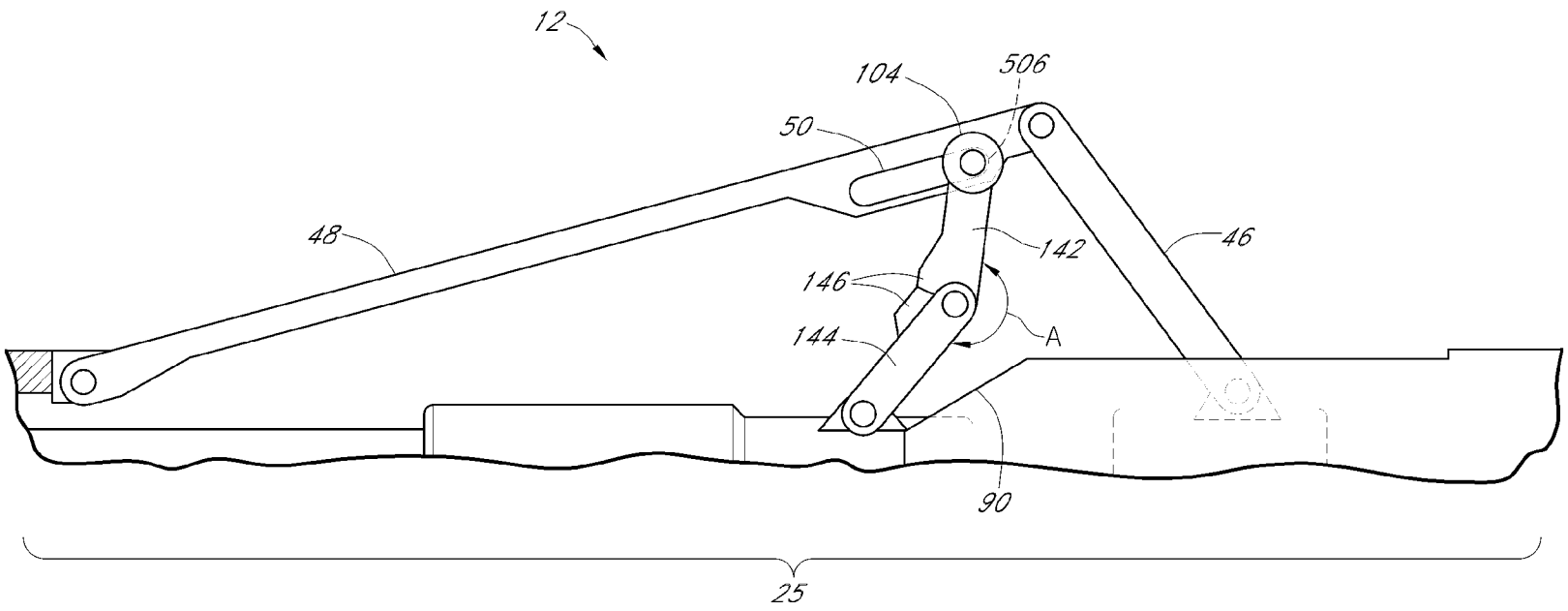
FIG. 17 is a schematic view of the linkage of FIG. 14 in a third stage of expansion.

With reference to FIG. 17, further expansion of the expandable assembly is illustrated. In this stage of expansion, the continued buckling of the elbow link 140 and longer lift link 46 away from the HE gripper assembly 10 body has radially expanded the tension link 48. The elbow link 140 preferably continues to act against the second end 506 of the slot 50 within the tension link 48 to radially expand the linkage. At this stage of expansion, desirably the elbow link 140 reaches an angle between 60-85 degrees from the elongate body 25 and the piston providing force to activate the elbow link 140 desirably reaches the end of its stroke. In some embodiments, including the illustrated embodiment, maximum expansion due to buckling of the elbow link 140 desirably occurs when the link 140 reaches an angle between 50 and 90 degrees, more desirably between 55 and 90 degrees, and even more desirably between 60 and 85 degrees, as measured from the elongate body 25. In some embodiments, including the illustrated embodiment, maximum expansion due to buckling of the elbow link 140 desirably occurs when the link 140 is at an angle of at least 50 degrees, more desirably when the link 140 is at an angle of at least 60 degrees, and most desirably when the link 140 is at an angle of at least 70 degrees, as measured from the elongate body 25. Preferably at this stage of expansion, the longer lift link 46 desirably is at an angle from the elongate body 25 such that the longer lift link 46 can provide additional expansion force.

Figure 18:
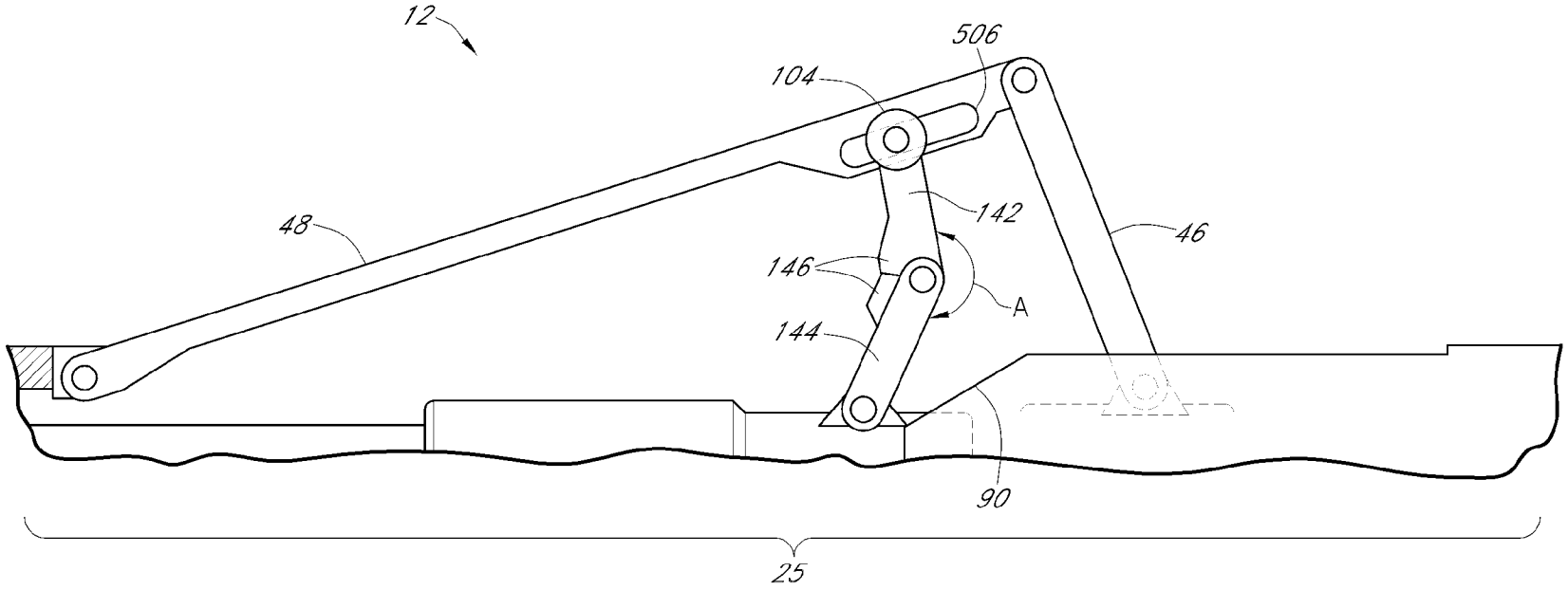
FIG. 18 is a schematic view of the linkage of FIG. 14 in a fourth stage of expansion.

FIG. 18 illustrates further expansion of the expandable assembly. Similar to the discussion above regarding FIG. 12, in this stage of expansion, the continued buckling of the tension link 48 is due to the force exerted by the actuator 20 on the longer lift link 46. Desirably, the elbow link 140 no longer provides expansion force and the shaft connecting the rollers 104 is free to move within the slot 50, therefore no longer acting against the second end 506 of the slot 50. When the longer lift link 46 desirably reaches an angle of 60 to 85 degrees as measured from the elongate body 25, the piston providing force to activate the longer lift link 46 desirably reaches the end of its stroke. Maximum expansion of the linkage due to the buckling of the longer lift link 46 desirably occurs when the link 46 reaches an angle between 50 and 90 degrees, more desirably between 55 and 90 degrees, and even more desirably between 60 and 85 degrees, as measured from the elongate body 25. In some embodiments, including the illustrated embodiment, maximum expansion due to buckling of the longer lift link 46 desirably occurs when the link 46 is at an angle of at least 50 degrees, more desirably when the link 46 is at an angle of at least 60 degrees, and most desirably when the link 46 is at an angle of at least 70 degrees, as measured from the elongate body 25. This position desirably represents the maximum possible expansion diameter of the gripper assembly.

Figure 13:
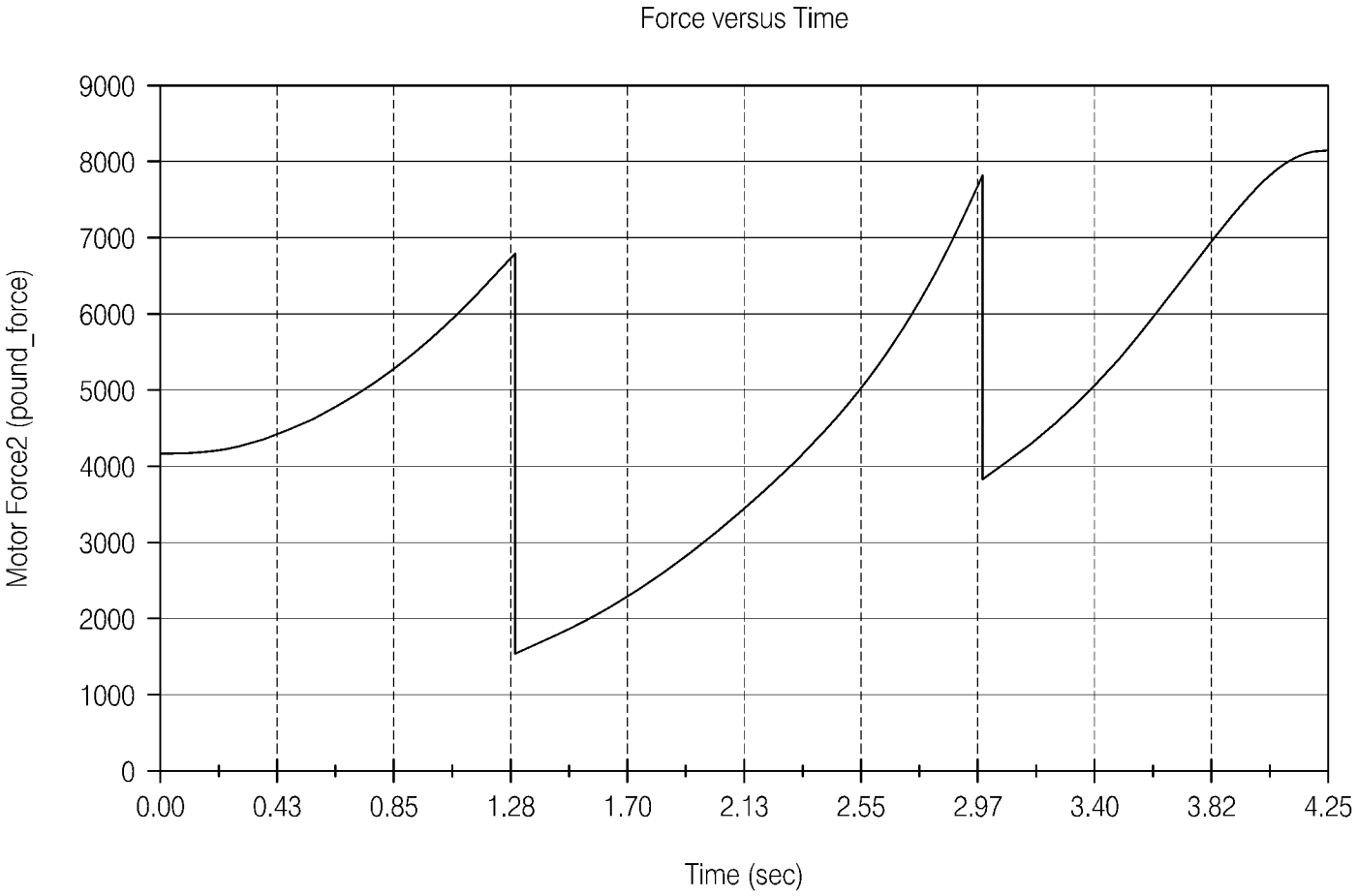
FIG. 13 is a line graph illustrating the expansion force exerted versus time for one embodiment of the gripper assembly of FIG. 1.

FIG. 13 illustrates expansion force versus expansion time for an exemplary HE gripper assembly 10 embodiment. While certain values for expansion forces are plotted on the graph of FIG. 13 and these values can provide significant benefits over other designs, unless otherwise stated, these values are not limiting and it is recognized that a HE gripper can be configured to operate in a wide range of expansion diameters to generate a wide range of expansion forces.

With continued reference to FIG. 13, in some embodiments, each gripper assembly of an HE gripper is configured such that the maximum expansion force generated is less than approximately 9,000 pounds and desirably less than approximately 8,000 pounds over the entire range of expansion of the gripper assembly. In some embodiments, the gripper assembly of an HE gripper may desirably produce at least 1000 lbs of expansion force, more desirably at least 2000 lbs of expansion force, and most desirably at least 3000 lbs of expansion force.

Although these inventions have been disclosed in the context of a certain preferred embodiment and examples, it will be understood by those skilled in the art that the present inventions extend beyond the specifically disclosed embodiments and embodiments disclosed in the incorporated U.S. Pat. No. 7,748,476, entitled "VARIABLE LINKAGE ASSISTED GRIPPER" to other alternative embodiments and/or uses of the invention and obvious modifications and equivalents thereof. Additionally, it is contemplated that various aspects and features of the inventions described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A gripper assembly comprising:

a link mechanism comprising a tension link having a first end and a second end, said tension link connected to a first and a second lift link; said first lift link pivotably connected to said tension link at said second end; said second lift link pivotably connected to said tension link at said second end so as not to be translatable between the first end and the second end of the tension link; said first and second lift links slidably attached to an elongate body;

a roller disposed on an end of said first lift link;

a slot disposed in said tension link adjacent the pivotable connection of the second lift link and the tension link, said slot comprising a first end and a second end opposite said first end, said first lift link translatable along said slot between the first end and the second end of the slot; and an expansion surface upon which said roller acts to provide an expansion force;

wherein for a first expansion range the movement of the roller upon the expansion surface expands the linkage; for a second expansion range the movement of the first lift link pushing against the second end of the slot expands the linkage; and for a third expansion range the movement of the second lift link expands the linkage.

2. The gripper assembly of claim 1, wherein the first lift link and the second lift link are different lengths.

3. The gripper assembly of claim 2, wherein the first lift link is shorter than the second lift link.

4. The gripper assembly of claim 2, wherein the ratio of the length of the first lift link to the length of the second lift link is less than 1.

5. The gripper assembly of claim 2, wherein a maximum angle of the first lift link with respect to the elongate body does not exceed 85 degrees.

6. The gripper assembly of claim 1 further comprising an interference mechanism comprising a plurality of gripping elements disposed on an outer surface of the tension link.

7. A gripper assembly comprising:

an elongate body; and at least one linkage comprising a first lift link, a second lift link and a tension link, wherein the second lift link and the tension link are pivotably interconnected in series and expandable relative to the elongate body from a retracted position to an expanded position;

wherein the first lift link has a first end slidably coupled to the elongate body and a second end disposed in a slot within the tension link, said slot having a first end and a second end, said slot adjacent the pivotable connection of the second lift link and the tension link; the second lift link has a first end slidably coupled to the elongate body and a second end that is radially extendable from the elongate body; the tension link has a first end radially fixed with respect to the body and pivotally coupled to the elongate body and a second end that is radially extendable from the elongate body; and for a first expansion range the movement of the second end of the first lift link pushing against the second end of the slot expands the linkage, and for a second expansion range the movement of the second lift link radially away from the elongate body expands the linkage.

8. The gripper assembly of claim 7 further comprising an expansion surface and at least one roller rotatably attached to the second end of the first lift link wherein movement of the roller along the expansion surface radially expands the linkage.

9. The gripper assembly of claim 8, wherein the expansion surface comprises a ramp.

10. The gripper assembly of claim 8, wherein the at least one roller is rotatably connected to a shaft that is free to slide within the slot in the tension link.

11. The gripper assembly of claim 8, wherein the gripper assembly is configured to prevent the collection of debris around and upon the expansion surface.

12. The gripper assembly of claim 7, wherein said first lift link further comprises two short links coupled in series.

13. The gripper assembly of claim 7 further comprising a gripper, the gripper defined by a flexible continuous beam coupled to the elongate body; the continuous beam being disposed over the linkage such that expansion of the linkage bows the continuous beam radially outward from the elongate body.

14. The gripper assembly of claim 7 further comprising a power section configured to generate a force generally aligned with a length of the gripper assembly to radially expand the linkage.

15. The gripper assembly of claim 7, wherein the assembly can collapse within a 3.5 inch diameter envelope.

16. The gripper assembly of claim 15, wherein the ratio of an outer diameter of the assembly in an expanded position to an outer diameter of the assembly in a collapsed position is at least 2.

17. The gripper assembly of claim 15, wherein the ratio of an outer diameter of the assembly in an expanded position to an outer diameter of the assembly in a collapsed position is between 3.4 and 6.

18. The gripper assembly of claim 7, wherein the ratio of an outer diameter of the assembly in an expanded position to an outer diameter of the assembly in a collapsed position is at least 2.

19. The gripper assembly of claim 18, wherein the difference between an outer diameter of the assembly in an expanded position to an outer diameter of the assembly in a collapsed position is at least 6 inches.

20. The gripper assembly of claim 18, wherein the difference between an outer diameter of the assembly in an expanded position to an outer diameter of the assembly in a collapsed position is at least 8 inches.

21. The gripper assembly of claim 7 further comprising an interference mechanism comprising a plurality of gripping elements located on an outer surface of the tension link and configured to have a small contact area between the gripper assembly and a surface of a wellbore formation.

22. The gripper assembly of claim 7, wherein the gripper assembly comprises at least two linkages.

23. The gripper assembly of claim 7, wherein the gripper assembly comprises at least three linkages.

24. A method for imparting a force to a passage, comprising:

positioning a force applicator in the passage, the force applicator comprising an expandable assembly comprising an elongate body and at least one linkage comprising a tension link having a first end radially fixed with respect to the body and coupled to the elongate body and a second end opposite the first end, a slot disposed in the tension link, said slot having a first end and a second end, a first lift link having a first end slidably coupled to the elongate body and a second end slidably disposed within the slot, a second lift link having a first end slidably coupled to the elongate body and a second end opposite the first end coupled to the second end of the tension link adjacent the slot;

generating a radial expansion force over a first expansion range by moving the second end of the first lift link against the second end of the slot to expand the linkage; and generating a radial expansion force over a second expansion range by moving the second end of the second lift link radially away from the elongate body to expand the linkage.

* * * * *